US011603258B2

(12) United States Patent
Casey

(10) Patent No.: US 11,603,258 B2
(45) Date of Patent: Mar. 14, 2023

(54) SLIDING PACKS WITH FLIP TOP HINGED LIDS

(71) Applicant: Altria Client Services LLC, Richmond, VA (US)

(72) Inventor: Brian Casey, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 17/847,693

(22) Filed: Jun. 23, 2022

(65) Prior Publication Data

US 2022/0315316 A1 Oct. 6, 2022

Related U.S. Application Data

(60) Continuation of application No. 17/242,430, filed on Apr. 28, 2021, now Pat. No. 11,383,918, which is a division of application No. 16/387,688, filed on Apr. 18, 2019, now Pat. No. 11,014,736.

(51) Int. Cl.
*B65D 85/10* (2006.01)

(52) U.S. Cl.
CPC ..... *B65D 85/1045* (2013.01)

(58) Field of Classification Search
CPC ..... B65D 85/1009; B65D 85/1054; B65D 85/1045; B65D 5/38; B65D 85/10; A24F 15/16; A24F 15/12
USPC ..... 206/242–276
See application file for complete search history.

(56) References Cited

U.S. PATENT DOCUMENTS

| | | | |
|---|---|---|---|
| 2,929,542 | A | 3/1960 | O'Gorman |
| 3,311,283 | A | 3/1967 | Shimada et al. |
| 3,933,299 | A | 1/1976 | Shimada et al. |
| 3,977,520 | A | 8/1976 | Grimm |
| 4,049,117 | A | 9/1977 | Grimm |
| 4,050,622 | A | 9/1977 | Shimada et al. |
| 4,216,898 | A | 8/1980 | Davies |
| 4,267,936 | A | 5/1981 | Pavlicek |
| 4,646,960 | A | 3/1987 | Challand |
| 6,474,468 | B1 | 11/2002 | Griffith |
| 7,604,117 | B2 | 10/2009 | Bourgoin et al. |
| 7,658,280 | B2 | 2/2010 | Bardet et al. |

(Continued)

FOREIGN PATENT DOCUMENTS

| | | |
|---|---|---|
| EP | 1640290 A | 3/2006 |
| EP | 1640290 A1 | 3/2006 |

(Continued)

*Primary Examiner* — Chun Hoi Cheung
(74) *Attorney, Agent, or Firm* — Harness, Dickey & Pierce, P.L.C.

(57) ABSTRACT

A slide-action hinged-lid pack includes a hinged-lid inner pack configured to hold consumer items. The hinged-lid inner pack includes a front wall, a back wall, a left side wall, a right side wall, a bottom wall and a hinged-lid pivotally connected to an upper end of the back wall for movement between an open position and a closed position, and an outer shell. The hinged-lid inner pack can slide from a first position at which the hinged-lid is in the closed position to a second position at which the hinged-lid is in the open position. The outer shell includes a first stop tab on an inner side of the back wall. The hinged-lid inner pack includes a second stop tab on a tongue extending from the hinged-lid, and a third stop tab on the back wall of the hinged-lid inner pack.

20 Claims, 18 Drawing Sheets

(56) References Cited

U.S. PATENT DOCUMENTS

| | | | |
|---|---|---|---|
| 7,891,542 | B2 | 2/2011 | Vickerstaff |
| 7,992,708 | B2 | 8/2011 | Hein et al. |
| 8,042,685 | B2 | 10/2011 | Bourgoin et al. |
| 8,167,124 | B2 | 5/2012 | Uesugi et al. |
| 8,245,841 | B2 | 8/2012 | Agirbas |
| 8,281,922 | B2 | 10/2012 | Chatelain |
| 8,464,867 | B2 | 6/2013 | Holloway et al. |
| 8,556,071 | B2 | 10/2013 | Holloway et al. |
| 8,745,962 | B2 | 6/2014 | Squarzoni et al. |
| 9,156,604 | B2 | 10/2015 | Roila et al. |
| 9,211,996 | B2 | 12/2015 | Petrucci et al. |
| 9,245,938 | B2 * | 1/2016 | Ohara ..... H01L 51/5234 |
| 9,254,938 | B2 | 2/2016 | Iwata et al. |
| 9,687,026 | B2 | 6/2017 | Clark et al. |
| 9,701,429 | B2 | 7/2017 | Squarzoni |
| 9,714,134 | B2 | 7/2017 | Tacchi et al. |
| 9,862,511 | B2 | 1/2018 | Lanzarini et al. |
| 9,902,553 | B2 | 2/2018 | Polloni et al. |
| 10,017,284 | B2 | 7/2018 | Testoni et al. |
| 10,046,875 | B2 | 8/2018 | Cavazza et al. |
| 10,053,279 | B2 | 8/2018 | Draghetti |
| 10,099,845 | B2 | 10/2018 | Knudsen |
| 10,285,438 | B2 | 5/2019 | Iwata |
| 10,597,222 | B2 | 3/2020 | Slavomir |
| 2003/0029746 | A1 | 2/2003 | Draghetti et al. |
| 2009/0008277 | A1 | 1/2009 | Agirbas |
| 2009/0255835 | A1 | 10/2009 | Pipes et al. |
| 2011/0062175 | A1 | 3/2011 | Nakamura et al. |
| 2014/0374291 | A1 | 12/2014 | Young |
| 2015/0321831 | A1 | 11/2015 | Ghini et al. |
| 2017/0225878 | A1 | 8/2017 | Slavomir |
| 2018/0029784 | A1 | 2/2018 | Paradiso et al. |
| 2018/0214531 | A1 | 8/2018 | Biolchi et al. |

FOREIGN PATENT DOCUMENTS

| | | | |
|---|---|---|---|
| FR | 2495114 | A1 | 6/1982 |
| JP | H1035644 | A | 2/1998 |
| JP | H11301659 | A | 11/1999 |
| WO | WO-2008054305 | A1 | 5/2008 |
| WO | WO-2009107521 | A1 | 9/2009 |
| WO | WO-2013145074 | A1 | 10/2013 |
| WO | WO-2014155361 | A1 | 10/2014 |
| WO | WO-2016063247 | A1 | 4/2016 |
| WO | WO-2016132313 | A1 | 8/2016 |
| WO | WO-2017002066 | A1 | 1/2017 |
| WO | WO-2017017643 | A1 | 2/2017 |
| WO | WO-2017017645 | A1 | 2/2017 |
| WO | WO-2017072731 | A1 | 5/2017 |
| WO | WO-2017109612 | A1 | 6/2017 |
| WO | WO-2018020427 | A1 | 2/2018 |

* cited by examiner

SLIDING PACKS WITH FLIP TOP HINGED LIDS

CROSS-REFERENCE TO RELATED APPLICATIONS

This application is a continuation application of U.S. application Ser. No. 17/242,430, filed on Apr. 28, 2021, which is a divisional application of U.S. application Ser. No. 16/387,688 filed on Apr. 18, 2019, the entire contents of each of which are hereby incorporated by reference.

FIELD

The present disclosure relates to hand held containers and in particular to packs for consumer articles, such as for example and without limitation, tobacco articles, smoking articles, pouches, cigars, or any other types of articles.

BACKGROUND

Smoking articles such as cigarettes and a variety of other consumer goods are commonly sold in hinge-lid containers having a body portion and a lid portion, which is hinged to the body portion. In conventional hinge-lid cigarette packs, the lid portion of the pack is hinged to the top of the rear wall of the body portion thereof along a transverse hinge line and the cigarettes stand in the body portion of the upright pack. When the pack is opened, by pivoting the front of the lid portion up and to the rear, the interior of the body portion is exposed, while in the closed position, the front wall, rear wall and side walls of the lid portion of the hinge-lid pack form vertical extensions of the corresponding walls of the body portion thereof.

It would be desirable for a pack of consumer goods to be opened and closed using new designs.

SUMMARY

According to an example embodiment, a slide-action hinged-lid pack comprises a hinged-lid inner pack configured for housing consumer items, the hinged-lid inner pack including a front wall, a back wall, a left side wall, a right side wall, a bottom wall and a hinged-lid pivotally connected to an upper end of the back wall for movement between an open position and a closed position, an outer shell including front, back and side walls wherein the hinged-lid inner pack is configured to move from a first position at which the hinged-lid is in the closed position to a second position at which the hinged-lid is in the open position, the outer shell including a first stop tab on an inner side of the back wall of the outer shell, the hinged-lid inner pack including a second stop tab on a tongue extending from the hinged-lid, and the hinged-lid inner pack including a third stop tab on the back wall of the hinged-lid inner pack, the second stop tab operable to engage the first stop tab during movement of the hinged-lid inner pack from the first position to the second position, and the third stop tab operable to abut the second stop tab when the hinged-lid inner pack is moved to the second position.

In an example embodiment, a top panel of the hinged-lid fits within an opening at upper ends of the front, back and side walls of the outer shell when the hinged-lid inner pack is in the first position.

In an example embodiment, the hinged-lid inner pack includes projections extending outward of the front and back walls of the hinged-lid inner pack such that the front and back walls of the hinged-lid inner pack are spaced inwardly of the front and back walls of the outer shell.

In an example embodiment, the projections are formed by a series of U-shaped cuts along fold lines between the front wall and side walls of the hinged-lid inner pack and a series of U-shaped cuts along fold lines between the back wall and the side walls of the hinged-lid inner pack.

In an example embodiment, the consumer items comprise a bundle including smoking articles, the bundle located in the hinged-lid inner pack such that a free end of the bundle is exposed when the hinged-lid is in the open position and a free end of the bundle is covered by the hinged-lid when the hinged-lid is in the closed position.

In an example embodiment, the consumer items comprise a bundle including smoking articles, the bundle located in the hinged-lid inner pack such that a free end of the bundle extends outward from the opening when the hinged-lid inner pack is in the second position.

In an example embodiment, the first stop tab comprises a downwardly extending flap connected by a fold line to the back wall of the outer shell.

In an example embodiment, the second stop tab comprises an upwardly extending flap connected by a fold line to the tongue.

In an example embodiment, the fold line includes perforations.

In an example embodiment, the third stop tab comprises an upwardly extending flap connected by a fold line to the back wall of the hinged-lid inner pack.

In an example embodiment, the hinged-lid inner pack is formed from a single blank including eleven panels connected by ten transverse fold lines.

In an example embodiment, the blank includes paperboard.

In an example embodiment, the eleven panels include a first panel connected to a second panel by a first transverse fold line of the ten transverse fold lines, the second panel connected to a third panel along a second transverse fold line of the ten transverse fold lines, the third panel connected to a fourth panel along a third transverse fold line of the ten transverse fold lines, the fourth panel connected to a fifth panel along a fourth transverse fold line of the ten transverse fold lines, the fifth panel connected to a sixth panel along a fifth transverse fold line of the ten transverse fold lines, the sixth panel connected to a seventh panel along a sixth transverse fold line of the ten transverse fold lines, the seventh panel connected to an eighth panel along a seventh transverse fold line of the ten transverse fold lines, the eighth panel connected to a ninth panel along an eighth transverse fold line of the ten transverse fold lines, the ninth panel connected to a tenth panel along a ninth transverse fold line of the ten transverse fold lines, and the tenth panel connected to an eleventh panel along a tenth transverse fold line of the ten transverse fold lines.

In an example embodiment, the second panel and the first panel form the front wall of the hinged-lid inner pack, the third panel forms at least a part of the bottom wall of the hinged-lid inner pack, the fourth panel forms the back wall of the hinged-lid inner pack, the fifth, sixth, seventh, eighth and ninth panels form at least a part of the hinged-lid, and the tenth and eleventh panels form the tongue.

In an example embodiment, the blank further includes twelve flaps, the twelve flaps including a first flap connected to one side of the second panel along a first longitudinal fold line, a second flap connected to an opposite side of the second panel along a second longitudinal fold line, a third flap connected to one side of the fourth panel along a third longitudinal fold line, a fourth flap connected to an opposite side of the fourth panel along a fourth longitudinal fold line, a fifth flap connected to the third flap along an eleventh transverse fold line, a sixth flap connected to the fourth flap along a twelfth transverse fold line, a seventh flap connected to one side of the fifth panel along a fifth longitudinal fold line, an eighth flap connected to an opposite side of the fifth panel along a sixth longitudinal fold line, a ninth flap connected to one side of the eighth panel along a seventh longitudinal fold line, a tenth flap connected to an opposite side of the eighth panel along an eighth longitudinal fold line, an eleventh flap connected to the ninth flap along a thirteenth transverse fold line, and a twelfth flap connected to the tenth flap along a fourteenth transverse fold line.

In an example embodiment, the first flap is adhered to the third flap, the second flap is adhered to the fourth flap, the fifth flap is adhered to the third panel, and the sixth flap is adhered to the third panel.

In an example embodiment, the seventh panel is adhered to the eighth panel, the seventh flap is adhered to the ninth flap, and the eighth flap is adhered to the tenth flap.

In an example embodiment, the ninth panel is adhered (a) to the sixth panel, (b) to the eleventh and twelfth flaps, or (c) to the sixth panel and to the eleventh and twelfth flaps; and wherein the eleventh and twelfth flaps are at least partially between the sixth and ninth panels.

In an example embodiment, the first longitudinal fold line includes a series of U-shaped cuts forming projections extending outwardly from the front wall of the hinged-lid inner pack, the second longitudinal fold line includes a series of U-shaped cuts forming projections extending outwardly from the front wall of the hinged-lid inner pack, the third longitudinal fold line includes a series of U-shaped cuts forming projections extending outwardly from the back wall of the hinged-lid inner pack, and the fourth longitudinal fold line includes a series of U-shaped cuts forming projections extending outwardly from the back wall of the hinged-lid inner pack.

In an example embodiment, the projections provide a first gap between the front wall of the outer shell and the front wall of the hinged-lid inner pack and a second gap between the back wall of the outer shell and the back wall of the hinged-lid inner pack.

In an example embodiment, the outer shell is formed by from a single blank including four panels connected by three transverse fold lines.

In an example embodiment, the blank includes paperboard.

In an example embodiment, the four panels include a first panel connected to one end of a second panel along a first transverse fold line of the three transverse fold lines, an opposite end of the second panel connected to one end of a third panel along a second transverse fold line of the three transverse fold lines, an opposite end of the third panel connected to a fourth panel along a third transverse fold line of the three transverse fold lines, the first panel forming the front wall of the outer shell, the second panel forming at least a part of a bottom wall of the outer shell, the third panel forming the back wall of the outer shell, the fourth panel forming the first stop tab, and the first panel having a finger slot therein configured to expose the front wall of the hinged-lid inner pack so that the hinged-lid inner pack can be manually moved towards and away from the bottom wall of the outer shell.

In an example embodiment, the blank further includes six flaps, the six flaps including a first flap connected to one side of the first panel along a first longitudinal fold line, a second flap connected to an opposite side of the first panel along a second longitudinal fold line, a third flap connected to one side of the third panel along a third longitudinal fold line, a fourth flap connected to an opposite side of the third panel along a fourth longitudinal fold line, a fifth flap connected to the third flap along a fourth transverse fold line, and a sixth flap connected to the fourth flap along a fifth transverse fold line, the first flap adhered to the third flap to form a first sidewall of the sidewalls of the outer shell, the second flap adhered to the fourth flap to form a second sidewall of the sidewalls of the outer shell, and the fifth and sixth flaps adhered to the second panel to form the bottom wall of the outer shell.

In an example embodiment, the first stop tab comprises a downwardly extending flap pivotally connected to an upper end of the back wall of the outer shell, the flap having a free end extending a first distance from the upper end of the back wall, and wherein said first distance is less than a second distance between the front wall and back wall of the outer shell; the second stop tab comprises a first upwardly extending flap connected to the tongue along a perforated transverse fold line; and the third stop tab comprises a second upwardly extending flap connected to the back wall of the hinged-lid inner pack along a second fold line.

In an example embodiment, the first upwardly extending flap has a trapezoidal shape formed by a first cutline in a central portion of the tongue, the first cutline including first and second angled sections extending from opposite ends of the perforated transverse fold line towards the free end of the tongue and a rectilinear section, the rectilinear section approximately parallel to and spaced from the perforated transverse fold line by a third distance which is less that the first distance, the first upwardly extending flap folded about 180 degrees or less with respect to the tongue such that a free end of the first upwardly extending flap faces away from the free end of the tongue.

In an example embodiment, the second upwardly extending flap has a trapezoidal shape formed by a second cutline in a central portion of the back wall of the hinged-lid inner pack, the second cutline including first and second angled sections extending from opposite ends of the second transverse fold line towards the lid of the hinged-lid inner pack and a rectilinear section, the rectilinear section approximately parallel to and spaced from the second transverse fold line by a fourth distance which is greater than the third distance.

In an example embodiment, curved sections connect the rectilinear section of the first upwardly extending flap to the angled sections of the first upwardly extending flap, and curved sections connect the rectilinear section of the second upwardly extending flap to the angled sections of the second upwardly extending flap.

In an example embodiment, a free end of the second upwardly extending flap abuts a bottom end of the first upwardly extending flap when the lid hinged-lid inner pack is in the second position.

In an example embodiment, the bottom end of the first upwardly extending flap includes the perforated transverse fold line.

In an example embodiment, a gap between the first upwardly extending flap and a portion of the tongue adjacent the first upwardly extending flap forms a catch which engages the free end of the downwardly extending flap when the hinged-lid inner pack is moved upward relative to the outer shell and causes the lid to rotate from a closed position to an open position.

In an example embodiment, a method of assembling the slide-action hinged-lid pack comprises assembling the hinged-lid inner pack from a pack blank including eleven panels, the eleven panels including a first panel connected to a second panel by a first transverse fold line, the second panel connected to a third panel along a second transverse fold line, the third panel connected to a fourth panel along a third transverse fold line, the fourth panel connected to a fifth panel along a fourth transverse fold line, the fifth panel connected to a sixth panel along a fifth transverse fold line, the sixth panel connected to a seventh panel along a sixth transverse fold line, the seventh panel connected to an eighth panel along a seventh transverse fold line, the eighth panel connected to a ninth panel along an eighth transverse fold line, the ninth panel connected to a tenth panel along a ninth transverse fold line, and the tenth panel connected to an eleventh panel along a tenth transverse fold line, the pack blank further including twelve flaps, the twelve flaps including a first flap connected to one side of the second panel along a first longitudinal fold line, a second flap connected to an opposite side of the second panel along a second longitudinal fold line, a third flap connected to one side of the fourth panel along a third longitudinal fold line, a fourth flap connected to an opposite side of the fourth panel along a fourth longitudinal fold line, a fifth flap connected to the third flap along an eleventh transverse fold line, a sixth flap connected to the fourth flap along a twelfth transverse fold line, a seventh flap connected to one side of the fifth panel along a fifth longitudinal fold line, an eighth flap connected to an opposite side of the fifth panel along a sixth longitudinal fold line, a ninth flap connected to one side of the eighth panel along a seventh longitudinal fold line, a tenth flap connected to an opposite side of the eighth panel along an eighth longitudinal fold line, an eleventh flap connected to the ninth flap along a thirteenth transverse fold line, and a twelfth flap connected to the tenth flap along a fourteenth transverse fold line, the method including adhering the first flap to the third flap, adhering the second flap to the fourth flap, adhering the fifth flap to the third panel, and adhering the sixth flap to the third panel, and adhering the seventh panel to the eighth panel, adhering the seventh flap to the ninth flap, adhering the eighth flap to the tenth flap, and adhering the ninth panel to the eleventh flap, to the twelfth flap and/or to the sixth panel, with the eleventh and twelfth flaps at least partially between the sixth and ninth panels.

In an example embodiment, the method further includes adhering the eleventh flap to the sixth panel, and adhering the twelfth flap to the sixth panel.

In an example embodiment, the outer shell comprises a single outer shell blank including a first panel connected to one end of a second panel along a first transverse fold line, an opposite end of the second panel connected to one end of a third panel along a second transverse fold line, an opposite end of the third panel connected to a fourth panel along a third transverse fold line, the first panel forming the front wall, the second panel forming the bottom wall, the third panel forming the back wall, the fourth panel forming the first stop tab, and the first panel having a finger slot therein configured to expose the front wall of the hinged-lid inner pack so that the hinged-lid inner pack can be manually moved towards and away from the bottom wall of the outer shell, the outer shell blank further including a first flap connected to one side of the first panel along a first longitudinal fold line, a second flap connected to an opposite side of the first panel along a second longitudinal fold line, a third flap connected to one side of the third panel along a third longitudinal fold line, a fourth flap connected to an opposite side of the third panel along a fourth longitudinal fold line, a fifth flap connected to the third flap along a fourth transverse fold line, and a sixth flap connected to the fourth flap along a fifth transverse fold line, the method comprising folding the fourth panel about 180 degrees with respect to the third panel and arranging the hinged-lid inner pack against the third and fourth panels, folding the third and fourth flaps against sides of the hinged-lid inner pack, folding the fifth and sixth flaps against the bottom wall of the hinged-lid inner pack, folding the second panel against the fifth and sixth flaps and adhering the second panel thereto to form the bottom wall of the outer shell, folding the first panel against the front wall of the hinged-lid inner pack, folding the first and second flaps against the third and fourth flaps and adhering the first and second flaps to the third and fourth flaps to complete the outer shell.

In an example embodiment, a paperboard blank for forming an outer shell of a slide-action hinged-lid pack package comprises a first panel connected to one end of a second panel along a first transverse fold line, an opposite end of the second panel connected to one end of a third panel along a second transverse fold line, an opposite end of the third panel connected to a fourth panel along a third transverse fold line, the first panel corresponding to a front wall of the outer shell, the second panel corresponding to a bottom wall of the outer shell, the third panel corresponding to a back wall of the outer shell, the fourth panel corresponding to a stop tab, and the first panel having a finger slot therein configured to expose a front wall of a hinged-lid inner pack when placed in the outer shell such that the hinged-lid inner pack can be manually moved towards and away from the bottom wall of the outer shell, the outer shell blank further including a first flap connected to one side of the first panel along a first longitudinal fold line, a second flap connected to an opposite side of the first panel along a second longitudinal fold line, a third flap connected to one side of the third panel along a third longitudinal fold line, a fourth flap connected to an opposite side of the third panel along a fourth longitudinal fold line, a fifth flap connected to the third flap along a fourth transverse fold line, and a sixth flap connected to the fourth flap along a fifth transverse fold line.

In an example embodiment, a blank for forming a hinged-lid inner pack comprises a first panel connected to a second panel by a first transverse fold line, the second panel connected to a third panel along a second transverse fold line, the third panel connected to a fourth panel along a third transverse fold line, the fourth panel connected to a fifth panel along a fourth transverse fold line, the fifth panel connected to a sixth panel along a fifth transverse fold line, the sixth panel connected to a seventh panel along a sixth transverse fold line, the seventh panel connected to an eighth panel along a seventh transverse fold line, the eighth panel connected to a ninth panel along an eighth transverse fold line, the ninth panel connected to a tenth panel along a ninth transverse fold line, and the tenth panel connected to an eleventh panel along a tenth transverse fold line, a first flap connected to one side of the second panel along a first longitudinal fold line, a second flap connected to an opposite side of the second panel along a second longitudinal fold line, a third flap connected to one side of the fourth panel along a third longitudinal fold line, a fourth flap connected to an opposite side of the fourth panel along a fourth longitudinal fold line, a fifth flap connected to the third flap along an eleventh transverse fold line, a sixth flap connected to the fourth flap along a twelfth transverse fold line, a seventh flap connected to one side of the fifth panel along a fifth longitudinal fold line, an eighth flap connected to an opposite side of the fifth panel along a sixth longitudinal fold line, a ninth flap connected to one side of the eighth panel along a seventh longitudinal fold line, a tenth flap connected to an opposite side of the eighth panel along an eighth longitudinal fold line, an eleventh flap connected to the ninth flap along a thirteenth transverse fold line, and a twelfth flap connected to the tenth flap along a fourteenth transverse fold line.

In an example embodiment, the eleventh panel includes a first cutline in a central portion thereof defining a first stop flap, the first cutline including first and second angled sections extending from opposite ends of a first perforated transverse fold line towards a free end of the eleventh panel and a rectilinear section, the rectilinear section approximately parallel to and spaced from the first perforated transverse fold line, the first stop flap being foldable about 180 degrees or less with respect to the eleventh panel such that a free end of the first stop flap faces away from the free end of the eleventh panel.

In an example embodiment, a slide-action hinged-lid pack comprises a hinged-lid inner pack for housing consumer items, the hinged-lid inner pack comprising a single blank assembled into a front wall, a back wall, a left side wall, a right side wall, a bottom wall, and a hinged-lid pivotally connected to an upper end of the back wall for movement between an open position and a closed position, the hinged-lid comprising a back wall, a double layer front wall, a double layer left side wall, a double layer right side wall and a double layer top wall, an outer shell including front, back and side walls, wherein the hinged-lid inner pack is configured to slide from a first position at which the hinged-lid is in the closed position to a second position at which the hinged-lid is in the open position, the outer shell including a first stop tab on an inner side of the back wall of the outer shell, the hinged-lid inner pack including a second stop tab on a tongue extending from the hinged-lid, and the hinged-lid inner pack including a third stop tab on the back wall of the hinged-lid inner pack, the second stop tab operable to engage the first stop tab during movement of the hinged-lid inner pack from the first position to the second position, and the third stop tab operable to abut the second stop tab when the hinged-lid inner pack is moved to the second position.

In an example embodiment, the top wall of the hinged-lid fits within an opening at upper ends of front, back and side walls of the outer shell when the hinged-lid inner pack is in the first position.

In an example embodiment, the hinged-lid inner pack includes projections extending outward of the front and back walls of the hinged-lid inner pack.

In an example embodiment, the projections are formed by a series of U-shaped cuts along fold lines between the front wall and side walls of the hinged-lid inner pack and a series of U-shaped cuts along fold lines between the back wall and the side walls of the hinged-lid inner pack.

In an example embodiment, the consumer items comprise a bundle including smoking articles, the bundle located in the hinged-lid inner pack such that a free end of the bundle is exposed when the hinged-lid is in the open position, and a free end of the bundle is covered by the hinged-lid when the lid is in the closed position.

In an example embodiment, the consumer items comprise a bundle including smoking articles, the bundle located in the hinged-lid inner pack such that a the free end of the bundle extends outward from the opening when the hinged-lid pack is in the second position.

In an example embodiment, the first stop tab comprises a downwardly extending flap connected to the back wall of the outer shell, the second stop tab comprises an upwardly extending flap connected to the tongue, and the third stop tab comprises an upwardly extending flap connected to the back wall of the hinged-lid inner pack.

DETAILD DESCRIPTION

Reference will now be made in detail to example embodiments, one or more examples of which are illustrated in each figure. Each example is provided by way of explanation and is not meant as a limitation. For example, features and/or method steps illustrated or described as part of one embodiment and/or method can be used on or in conjunction with other exemplary embodiments and/or method steps to yield yet further exemplary embodiments or methods. It is intended that the present disclosure includes modifications and variations.

When terms like "about," "approximately," or the like are used in this specification in connection with numerical values, geometrical concepts, etc. it is intended that the associated numerical values, geometrical concepts, etc. include a tolerance of ±10% unless the context indicates otherwise.

Figure 1:
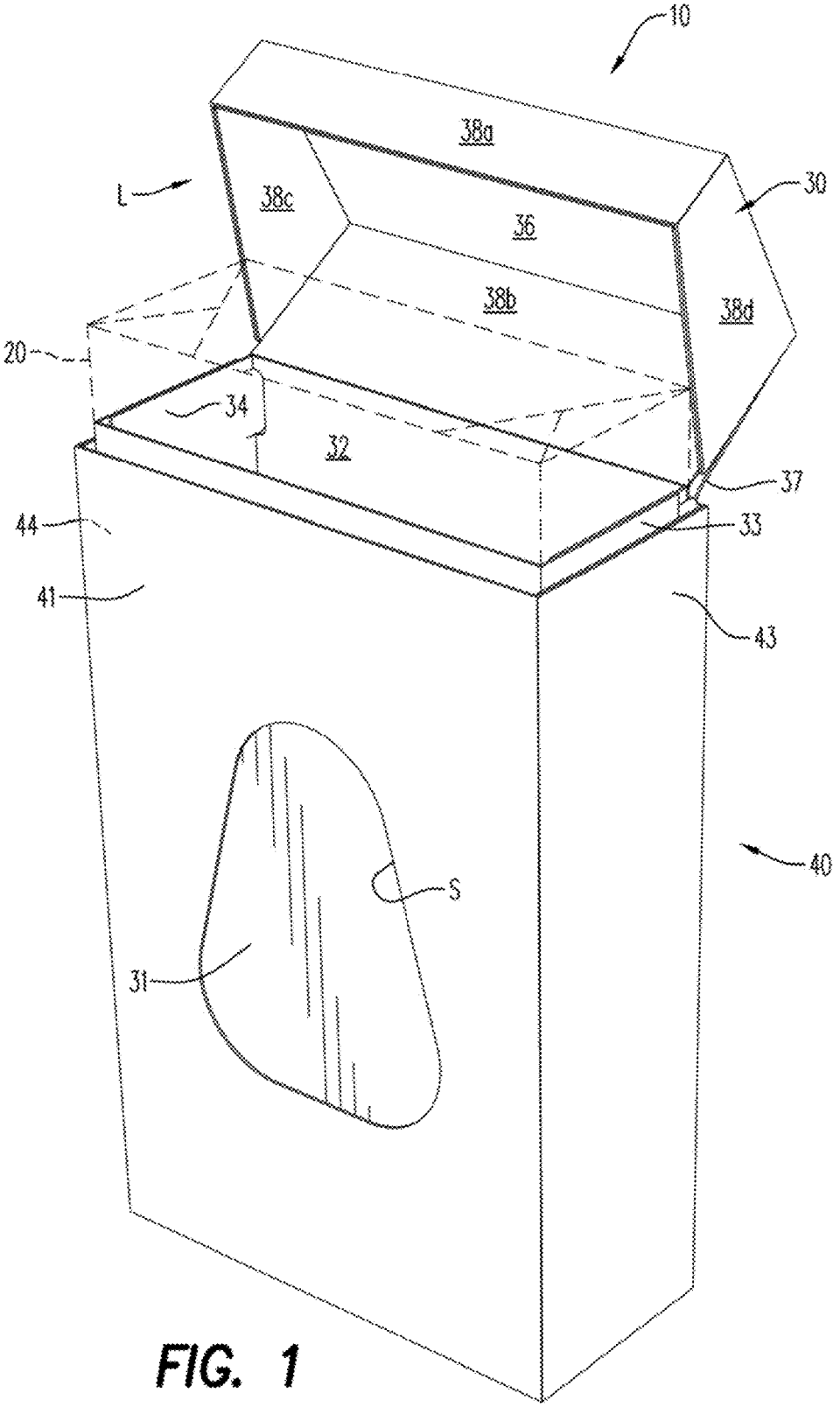
FIG. 1 is a perspective view of an open slide-action hinged-lid pack in accordance with an example embodiment.
Figure 2:
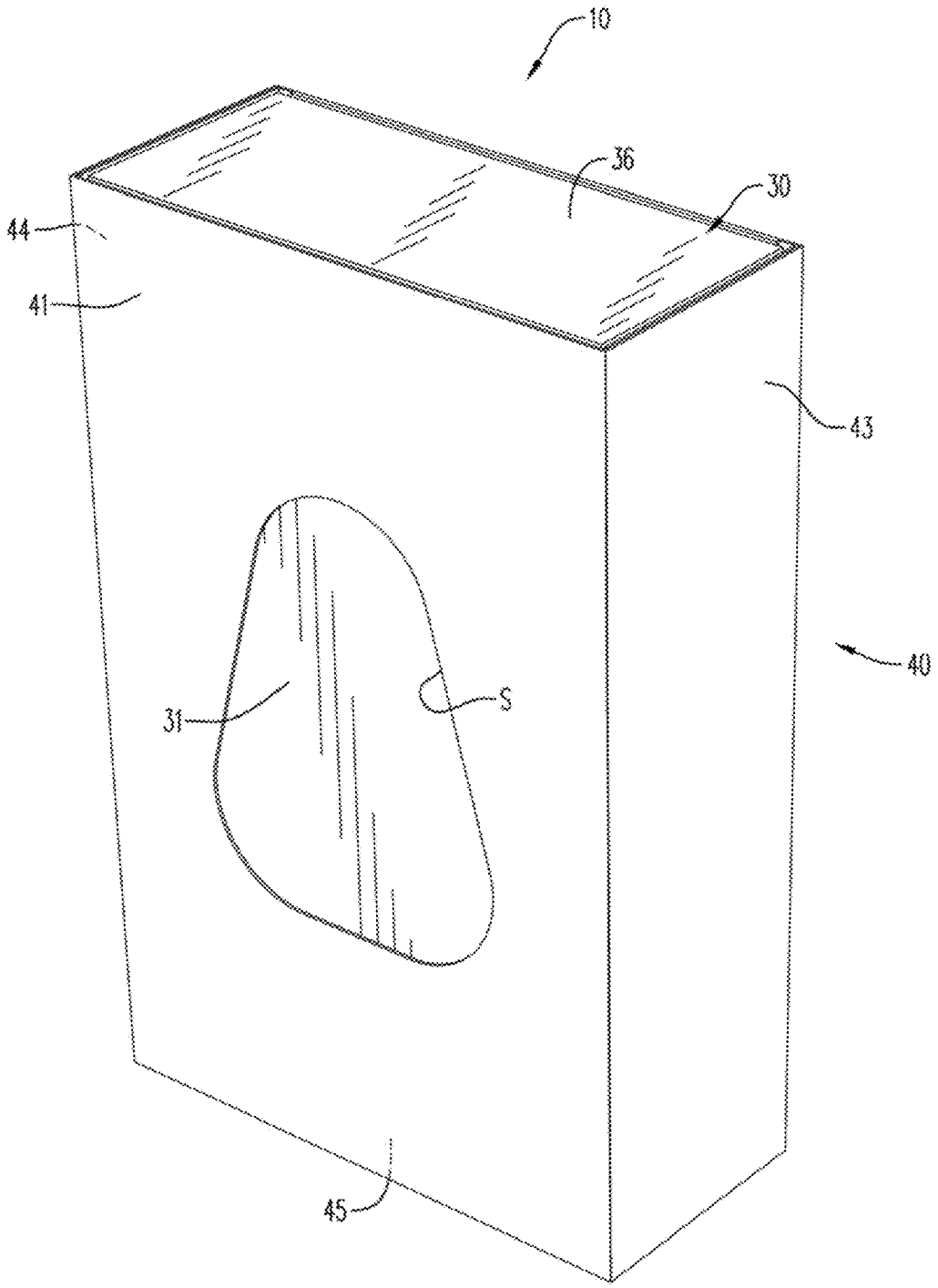
FIG. 2 is a perspective view of a closed slide-action hinged-lid pack in accordance with an example embodiment.
Figure 3:
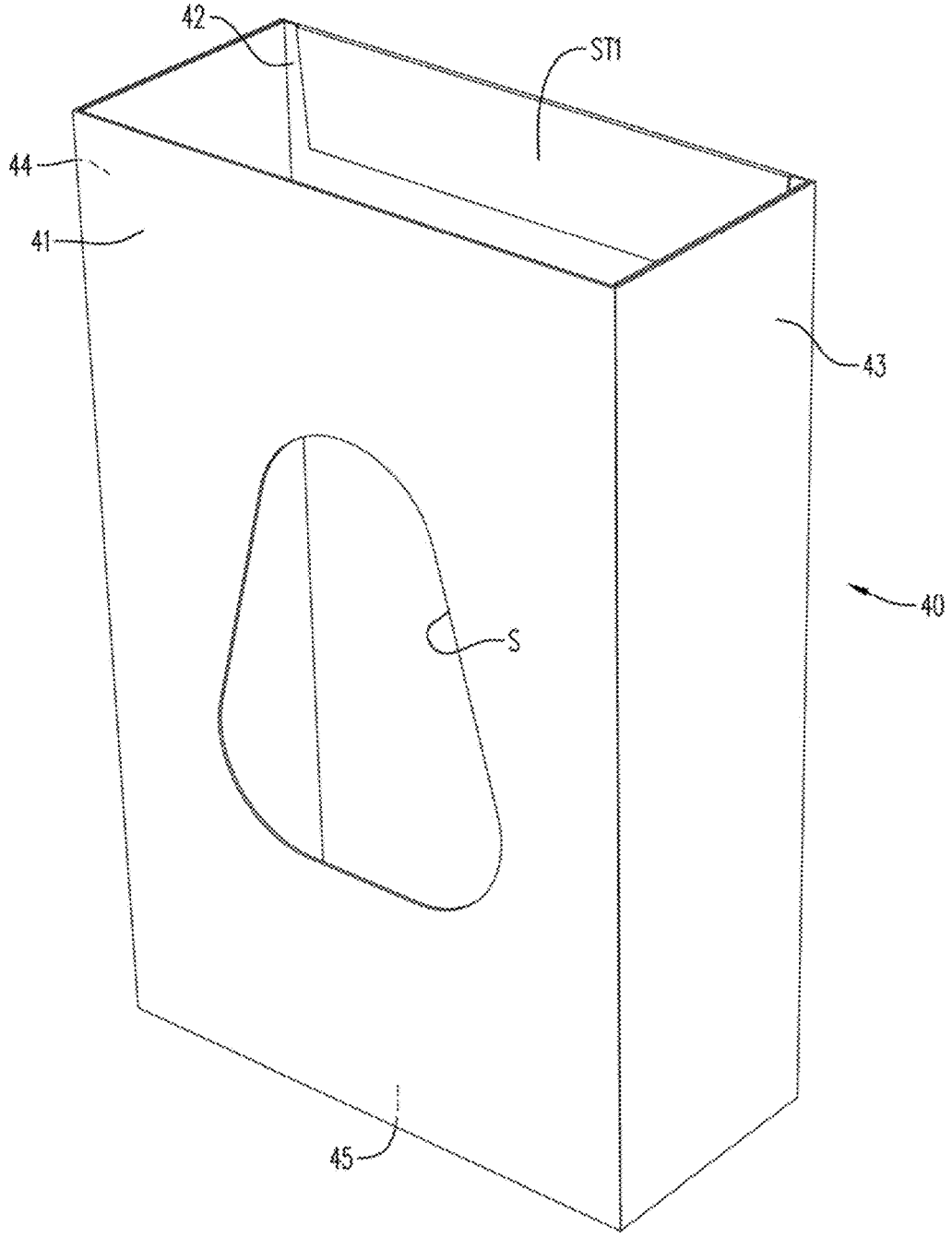
FIG. 3 is a perspective view of an outer shell of a slide-action hinged-lid pack in accordance with an example embodiment.
Figure 4:
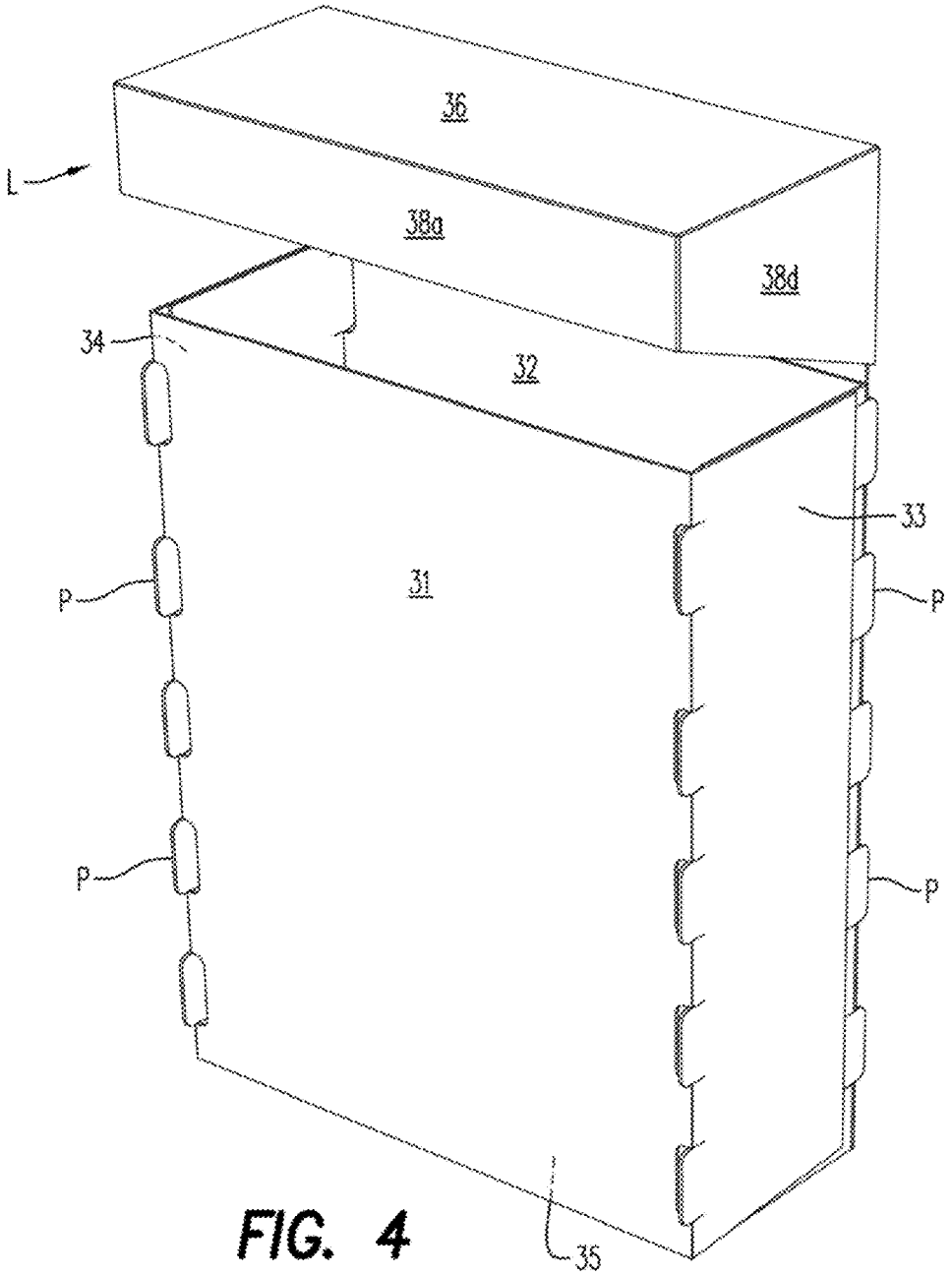
FIG. 4 is a perspective view of an inner pack of a slide-action hinged-lid pack in accordance with an example embodiment.
Figure 5A:
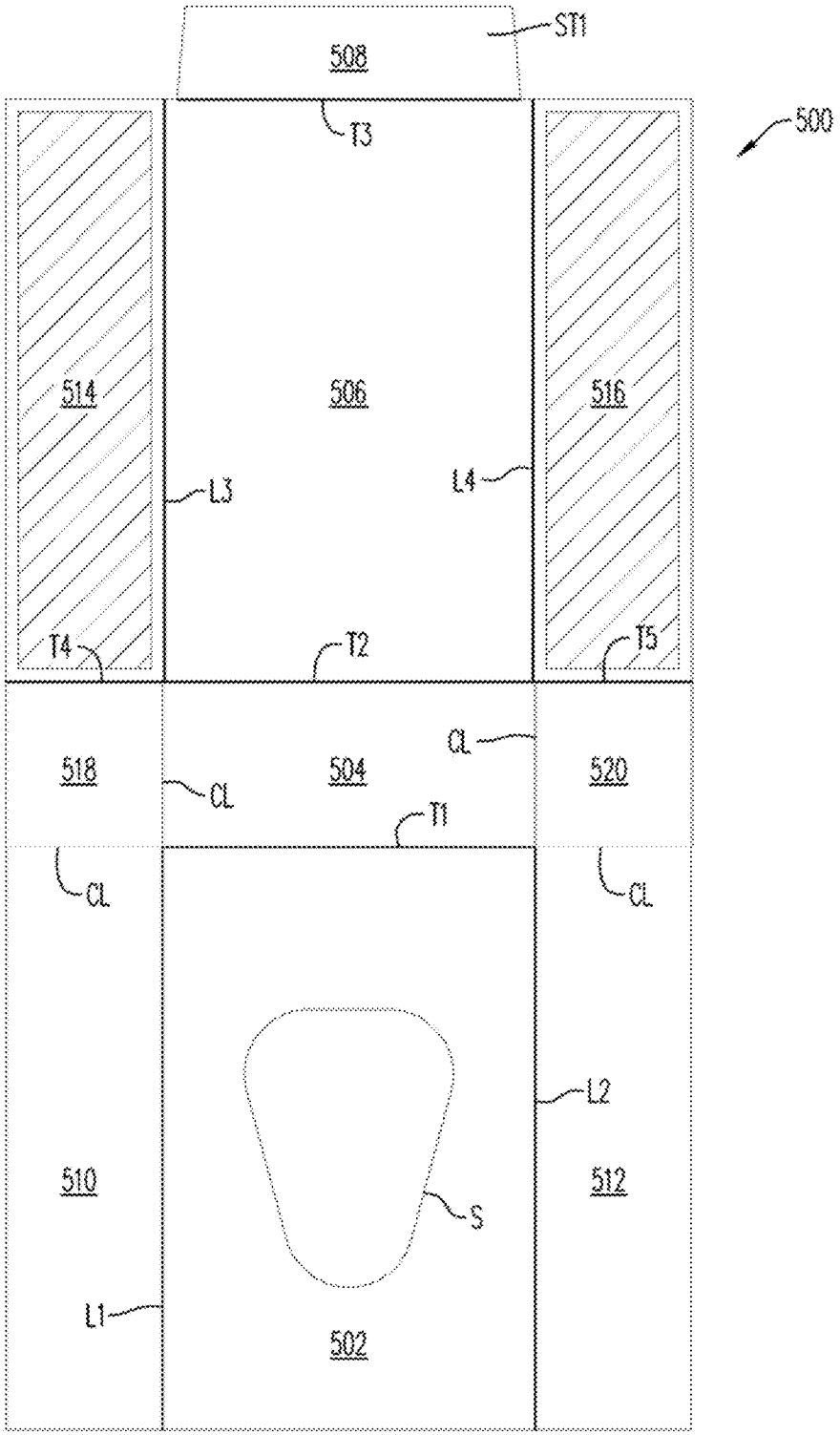
FIG. 5A is a plan view of an outer shell blank which can be assembled to form an outer shell of a slide-action hinged-lid pack wherein a finger slot is located in a front wall of the outer shell in accordance with an example embodiment.
Figure 6:
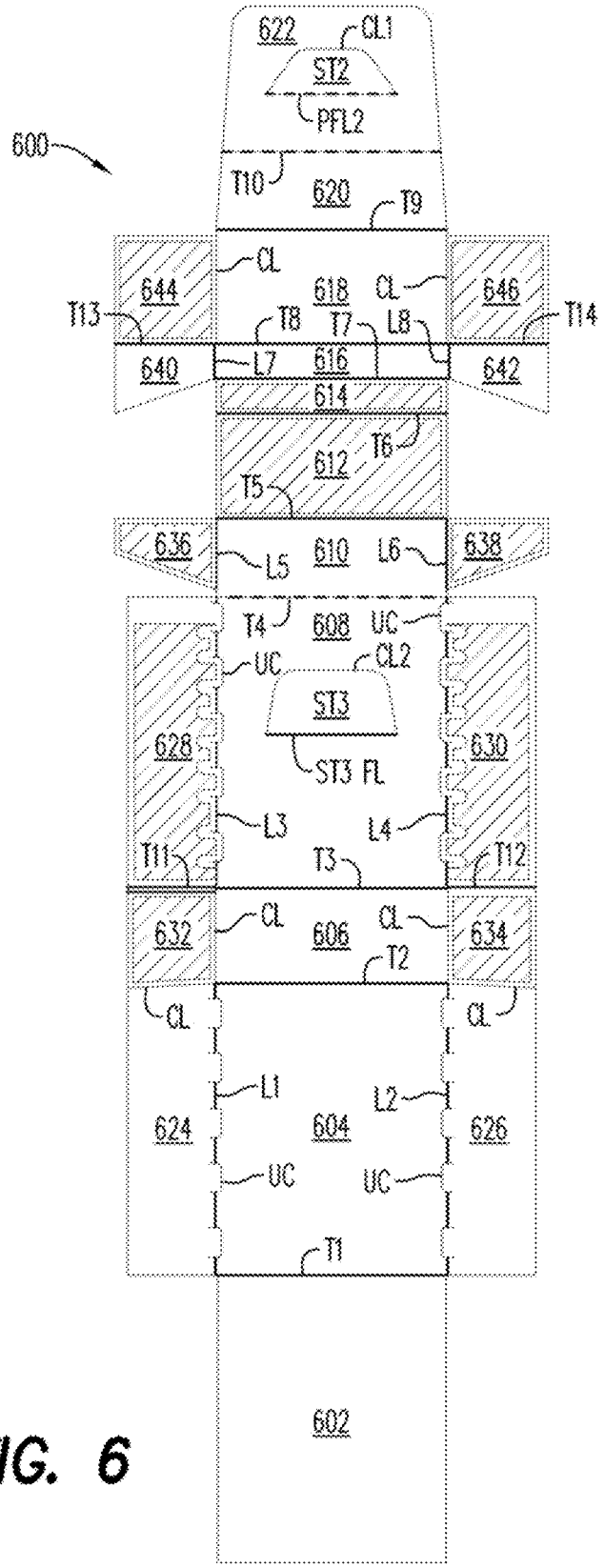
FIG. 6 is a plan view of an inner pack blank which can be assembled to form an inner pack of a slide-action hinged-lid pack in accordance with an example embodiment.

FIGS. 1 and 2 are perspective views of an example embodiment which show a slide-action hinged-lid pack 10 useful for consumer items such as for example and without limitation, tobacco articles, smoking articles, pouches, cigars, or any other types of articles. In an example embodiment, the pack 10 can include a bundle 20 of smoking articles, a hinged-lid inner pack 30 enclosing the bundle 20 of consumer articles, and an outer shell 40. FIG. 3 is a perspective view of the outer shell 40 and FIG. 4 is a perspective view of the hinged-lid inner pack 30. FIG. 5A shows an outer shell blank 500 comprised of panels which can be folded and adhered to form the outer shell 40 and FIG. 6 shows a hinged-lid inner pack blank 600 comprised of panels which can be folded and adhered to form the hinged-lid inner pack 30.

As shown in FIG. 4, a hinged-lid inner pack 30 according to an example embodiment can include a front wall 31, a back wall 32, a right side wall 33, a left side wall 34, and a bottom wall 35. A hinged-lid L is pivotally connected to an upper end of the back wall 32 for movement between an open position (FIG. 1 shows an example of an open position) at which a free end of the bundle 20 is exposed to a closed position at which the free end of the bundle 20 is covered by the hinged-lid L (FIG. 2 shows an example of a closed position). In some example embodiments, the outer shell 40 and hinged-lid inner pack 30, including blanks that create 40 and 30, can be made of paperboard material, including, for example and without limitation, 12 to 14 point paperboard material (in other examples, less than 12 point or greater than 14 point paperboard material may be used), and in some example embodiments may be laminated or coated with a metalized layer and/or polymer layer. In some example embodiments, the outer shell 40 and hinged-lid inner pack 30, as well as blanks that create 40 and 30, can be made of any material or combination of materials that have rigid properties and/or foldable properties. In some example embodiments, the outer shell 40 and hinged-lid inner pack 30, as well as blanks that create 40 and 30, can be made of any material or combination of materials that may be suitable for cigarette packs. In some example embodiments, the wrapped bundle 20 can house a bundle of cigarettes or other smoking articles, tobacco articles, pouches, cigars, or any other type of articles, in some example embodiments the articles being wrapped in a soft wrapping or reclosable pouch made of any suitable material such as, for example and without limitation, paper, a laminate of paper, foil, metal foil, metalized paper, and/or any other suitable material.

The pack 10 can have any desired dimensions depending on the length and/or size of the articles to be contained within the pack. For example, in some example embodiments, the pack 10 can be pocket sized and dimensioned to hold smoking articles. For example and without limitation, for 80-85 mm long smoking articles, the pack 10, when closed, can have a length of about 85-95 mm, a width of about 55-65 mm, and a depth of about 20-30 mm. Any other dimensions may be used depending on the length and/or size of the articles to be contained within the pack. In some example embodiments, the pack can be pocket sized and/or dimensioned to hold various sized articles.

As shown in FIG. 3, an outer shell 40 according to an example embodiment can include a front wall 41, a back wall 42, a right side wall 43, a left side wall 44 and a bottom wall 45. In an example embodiment, the hinged-lid inner pack 30 can slide from a first position in the outer shell 40 (FIG. 2 shows an example of a first position) at which a top wall 36 of the hinged-lid L is in the closed position and fits within a rectangular opening at upper ends of the front, back and side walls 41-44 of the outer shell 40 to a second position (FIG. 1 shows an example of a second position) at which the hinged-lid L is in an open position and the free end of a bundle 20 extends outward from the opening.

An outer shell 40 according to an example embodiment includes a first stop tab ST1 that extends from an upper end of the back wall 42, and is folded inward to overlap a portion of an inner side of the back wall 42. The hinged-lid inner pack 30 includes a second stop tab ST2 on a tongue 37 that extends from an upper corner of the hinged-lid L (tongue 37 of an example embodiment is formed by panels 620 and 622 shown in FIG. 6). The hinged-lid inner pack 30 includes a third stop tab ST3 on the back wall 32. The second stop tab ST2 is operable to engage the first stop tab ST1 during movement of the hinged-lid inner pack 30 from a closed position to an open position. The third stop tab ST3 is operable to abut a bottom portion of the second stop tab ST2 as the hinged-lid inner pack 30 is being opened to stop the opening movement. More particularly, in some example embodiments, as a hinged-lid inner pack 30 is moved upward from a closed position in the outer shell 40, to an open position, stop tab ST2 will be inserted into a space between ST1 and back wall 42 to create an engagement with ST1. Said engagement will make the hinged-lid L move from a closed position to an open position as the inner pack 30 is moved upward. As the movement continues, a bottom portion of ST2 will abut a top portion of ST3, to stop the opening movement.

A hinged-lid inner pack 30 according to some example embodiments can include projections P extending outward of the front and back walls 31, 32 of the hinged-lid inner pack 30 such that the front and back walls 31, 32 of the hinged-lid inner pack 30 are spaced inwardly of the front and back walls 41, 42 of the outer shell 40 when the hinged-lid inner pack 30 is inserted inside the outer shell 40. The projections P are formed by spaced apart U-shaped cuts UC along fold lines between a panel forming the front wall 31 and panels forming the side walls 33, 34 and U-shaped cuts UC along fold lines between a panel forming the back wall 32 and panels forming the side walls 33, 34.

As explained in more detail with reference to FIGS. 5A and 6, an outer shell blank 500 and a hinged-lid inner pack blank 600 according to example embodiments can include features forming a first, second and third stop tabs ST1, ST2 and ST3. For example, the first stop tab ST1 can comprise a downwardly bent flap extending from the back wall 42 of the shell 40 along a fold line at an upper end of the back wall 42. Similarly, the second stop tab ST2 can comprise an upwardly bent flap formed by a cutline in the tongue 37 and the third stop tab ST3 can comprise an outwardly extending flap formed by a cutline in the back wall 32 of the hinged-lid inner pack 30. In some example embodiments, when the hinged-lid inner pack 30 is inside the outer shell 40 in a closed position, movement of the hinged-lid inner pack 30 away from the bottom wall 45 causes the second stop tab ST2 to engage the first stop tab ST1 and pull the lid L open as the hinged-lid inner pack 30 moves further away from the bottom wall 45 of the outer shell 40. When a bottom portion of the second stop tab ST2 abuts a top portion of the third stop tab ST3, the hinged-lid inner pack 30 is prevented from further movement away from the bottom wall 45 and from further opening the lid L.

In an example embodiment, the hinged-lid inner pack 30 can be formed from a single inner pack blank 600 including eleven panels connected by ten transverse fold lines and twelve flaps connected by fold lines to the panels or other flaps (see FIG. 6) and the outer shell 40 can be formed from a single outer shell blank 500 including four panels connected by three transverse fold lines and six flaps connected by fold lines to panels or other flaps (see FIG. 5A). In some example embodiments, one or more of the fold lines of the blank 600 and/or the blank 500 may be perforated to improve folding capabilities between the panels and/or flaps connected by said fold lines (examples of these perforations can be seen, for example, in fold line T4 and fold line T10, but more or less fold lines may include perforations)

As shown in FIG. 6, an inner pack blank 600 of an example embodiment can include a first panel 602 connected to a second panel 604 along a first transverse fold line T1, the second panel 604 connected to a third panel 606 along a second transverse fold line T2, the third panel 606 connected to a fourth panel 608 along a third transverse fold line T3, the fourth panel 608 connected to a fifth panel 610 along a fourth transverse fold line T4, the fifth panel 610 connected to a sixth panel 612 along a fifth transverse fold line T5, the sixth panel 612 connected to a seventh panel 614 along a sixth transverse fold line T6, the seventh panel 614 connected to an eighth panel 616 along a seventh transverse fold line T7, the eighth panel 616 connected to a ninth panel 618 along an eighth transverse fold line T8, the ninth panel 618 connected to a tenth panel 620 along a ninth transverse fold line T9, and the tenth panel 620 connected to an eleventh panel 622 along a tenth transverse fold line T10. In an assembled hinged-lid inner pack 30 of an example embodiment, the second panel 604 and the first panel 602 form the front wall 31, the third panel 606 forms the bottom wall 35 (flaps 632 and 634 also form part of bottom wall 35 in example embodiments that include said flaps 632,634), the fourth panel 608 forms the back wall 32, the fifth, sixth, seventh, eighth and ninth panels 610, 612, 614, 616, 618 form walls 38*a*, 36 and 38*b* of the hinged-lid L (flaps 644 and 646 also form part of wall 36 of the hinged-lid L in example embodiments that include said flaps 644,646), flaps 636, 638, 640, 642 form walls 38*c* and 38*d* of the hinged-lid L, and the tenth and eleventh panels 620, 622 form the tongue 37.

As shown in FIG. 5A, an outer shell blank 500 of an example embodiment can include a first panel 502 connected to a second panel 504 along a first transverse fold line T1, the second panel 504 connected to a third panel 506 along a second transverse fold line T2, and the third panel 506 connected to a fourth panel 508 along a third transverse fold line T3, and six flaps connected by fold lines to panels or other flaps. One or more of the flaps can be adhered to other portions of the outer shell blank 500 to form the outer shell 40. An example embodiment can include a first side flap 510 connected to one side of the first panel 502 along a first longitudinal fold line L1, a second side flap 512 connected to an opposite side of the first panel 502 along a second longitudinal fold line L2, a third side flap 514 connected to one side of the third panel 506 along a third longitudinal fold line L3, a fourth side flap 516 connected to an opposite side of the third panel 506 along a fourth longitudinal fold line L4, a fifth side flap 518 connected to one end of the third side flap 514 along a fourth transverse fold line T4, and a sixth side flap 520 connected to one end of the fourth side flap 516 along a fifth transverse fold line T5. In the blank 500 shown in FIG. 5A, the fifth and sixth flaps 518, 520 are separated from the first and second flaps 510, 512 and second panel 504 by cut lines CL. However, the fifth and sixth flaps 518, 520 can have other arrangements such as fold line connections to first and second panels 510, 512 or fold line connections to the second panel 504.

Figure 5B:
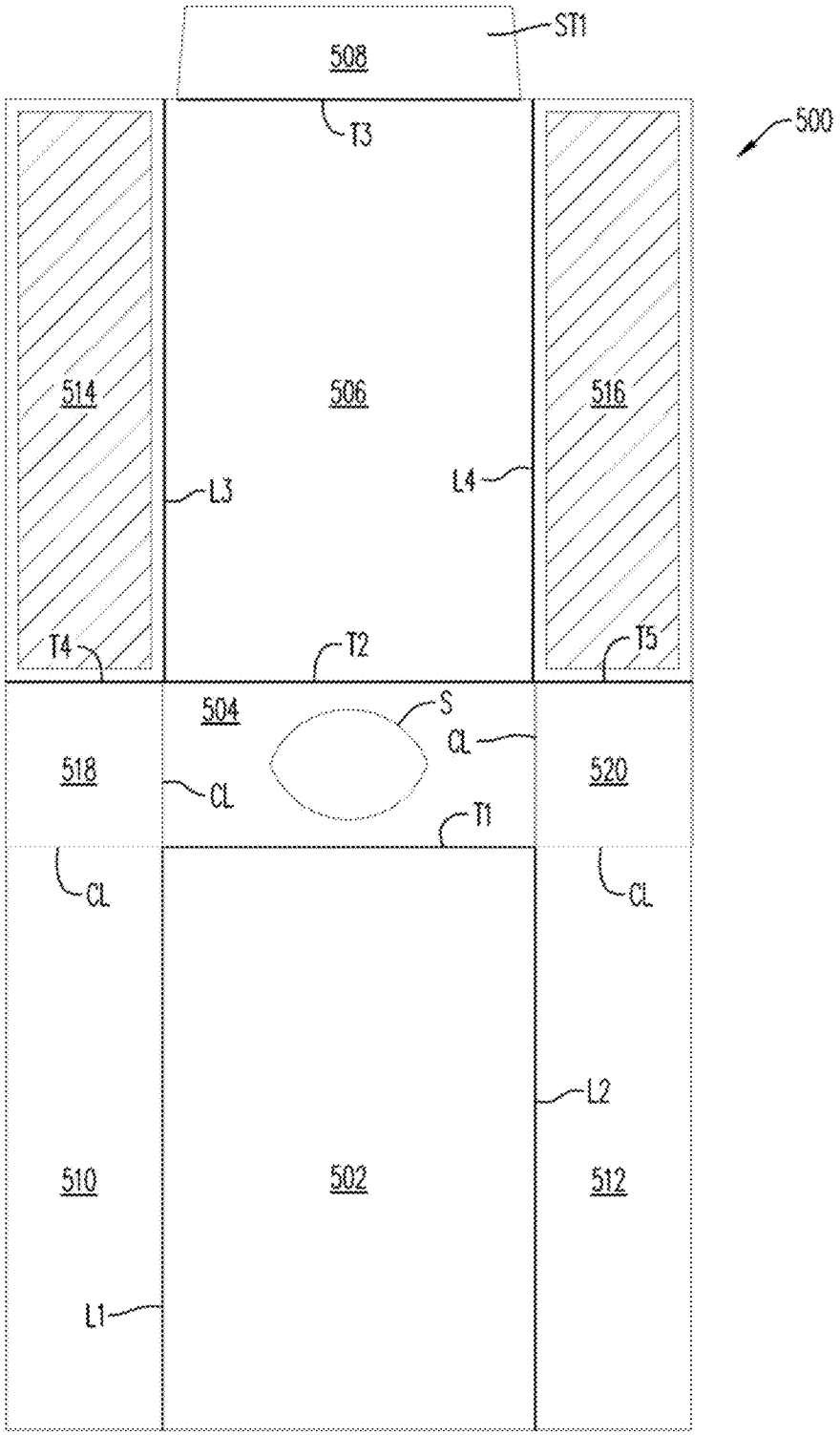
FIG. 5B is a plan view of an outer shell blank which can be assembled to form an outer shell of a slide-action hinged-lid pack wherein a finger slot is located in a bottom wall of the outer shell in accordance with an example embodiment.
Figure 5C:
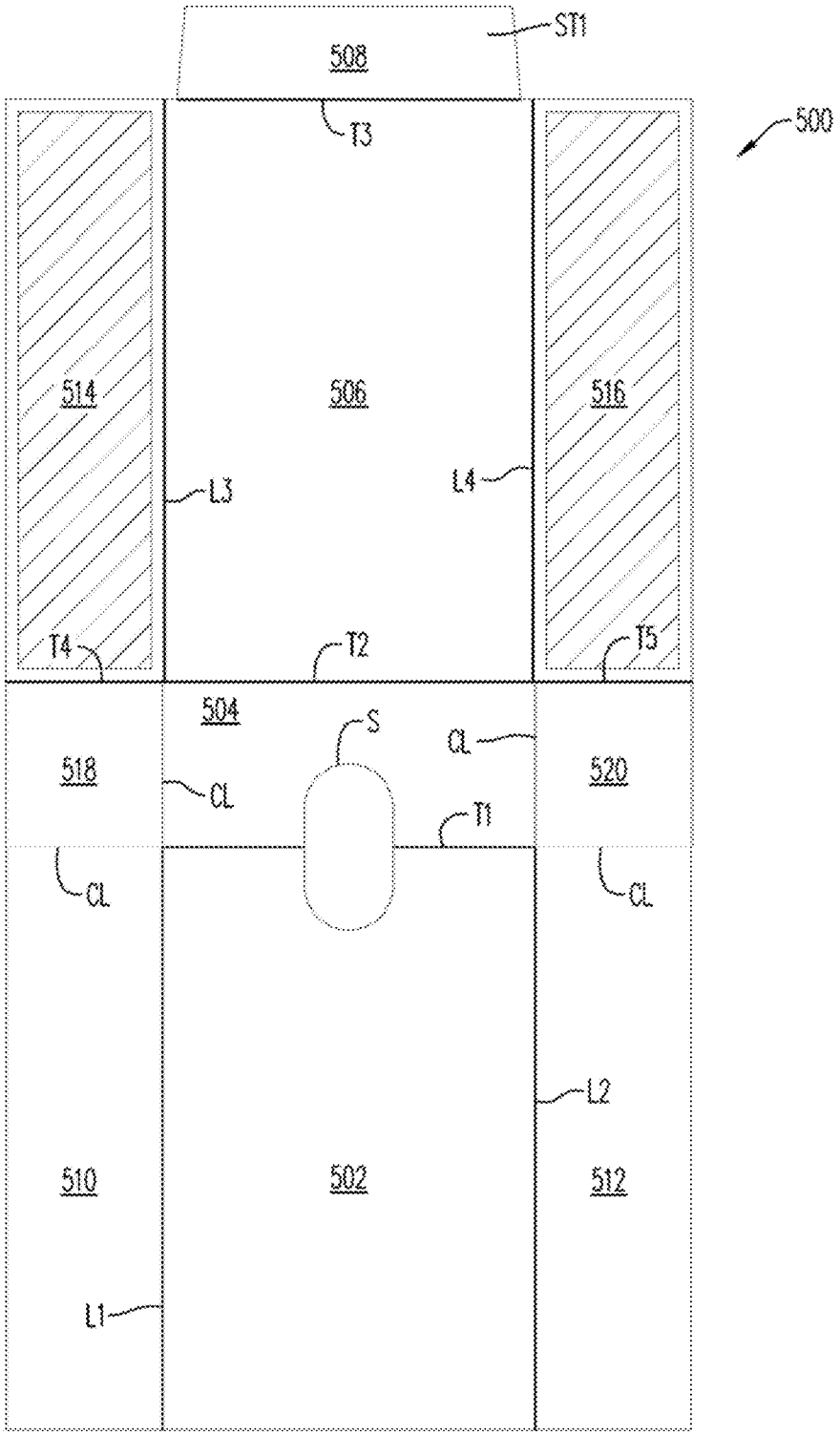
FIG. 5C is a plan view of an outer shell blank which can be assembled to form an outer shell of a slide-action hinged-lid pack wherein a finger slot extends from a front wall to a bottom wall of the outer shell in accordance with an example embodiment.
Figure 5D:
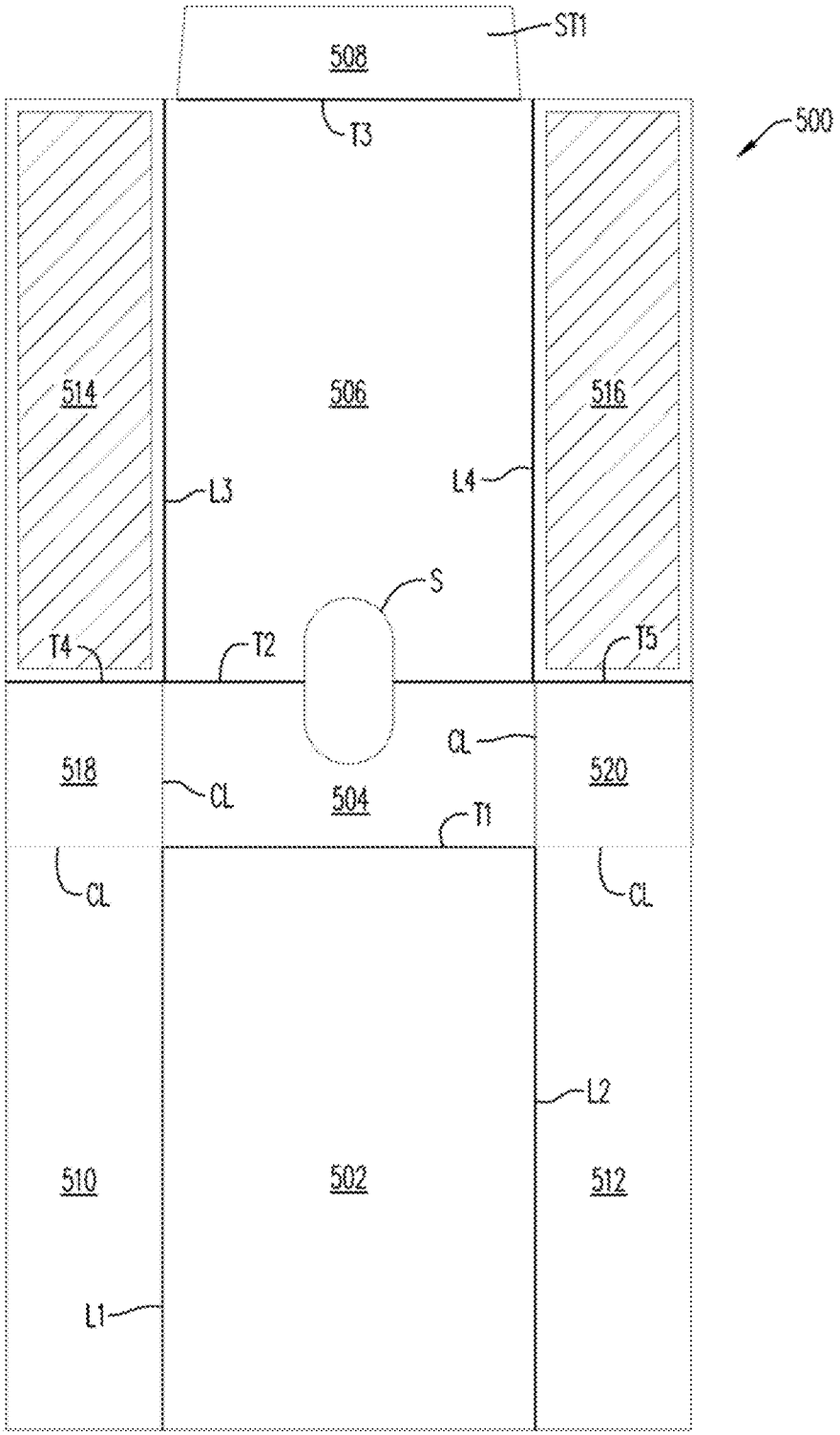
FIG. 5D is a plan view of an outer shell blank which can be assembled to form an outer shell of a slide-action hinged-lid pack wherein a finger slot extends from a bottom wall to a back wall of the outer shell in accordance with an example embodiment.
Figure 5E:
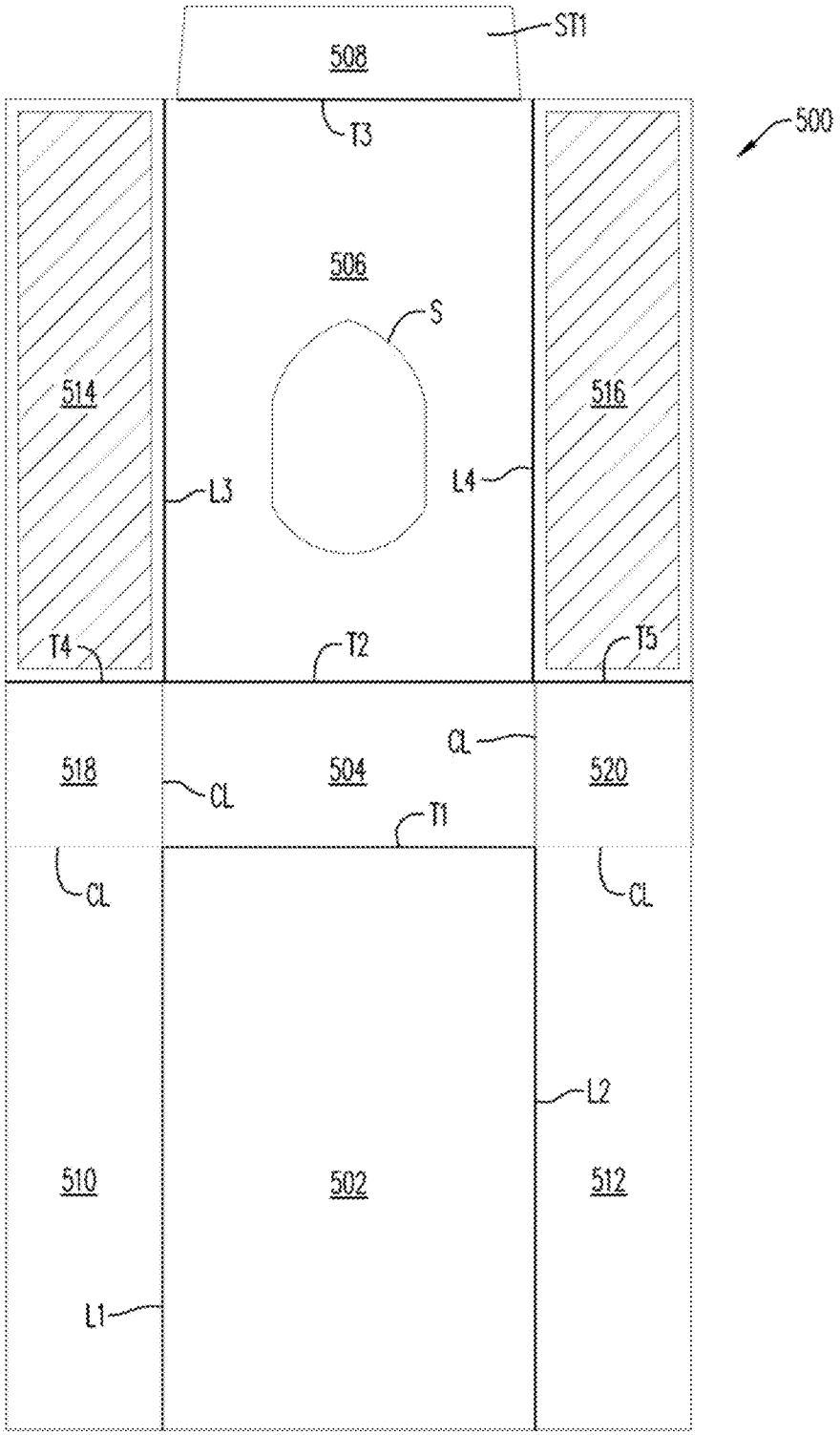
FIG. 5E is a plan view of an outer shell blank which can be assembled to form an outer shell of a slide-action hinged-lid pack wherein a finger slot is located in a back wall of the outer shell in accordance with an example embodiment.

As shown in FIG. 5A, the first panel 502 can have a finger slot S therein which allows opening of the pack 10 by pressing upward on the hinged-lid inner pack 30 when assembled in the outer shell 40. However, the finger slot S can have any desired shape and/or be located in a different panel or combination of panels. For example, FIG. 5B is a plan view of an outer shell blank which can be assembled to form an outer shell of a slide-action hinged-lid pack wherein a finger slot S is located in a bottom wall of the outer shell in accordance with an example embodiment. FIG. 5C is a plan view of an outer shell blank which can be assembled to form an outer shell of a slide-action hinged-lid pack wherein a finger slot S extends from a front wall to a bottom wall of the outer shell in accordance with an example embodiment. FIG. 5D is a plan view of an outer shell blank which can be assembled to form an outer shell of a slide-action hinged-lid pack wherein a finger slot S extends from a bottom wall to a back wall of the outer shell in accordance with an example embodiment. FIG. 5E is a plan view of an outer shell blank which can be assembled to form an outer shell of a slide-action hinged-lid pack wherein a finger slot S is located in a back wall of the outer shell in accordance with an example embodiment.

An outer shell 40 of an example embodiment can be assembled as follows. Third and fourth side flaps 514, 516 are folded about ninety degrees with respect to the third panel 506, the fifth side flap 518 is folded about ninety degrees with respect to the third side flap 514, the sixth side flap 520 is folded about ninety degrees with respect to the fourth side flap 516, the second panel 504 is folded about ninety degrees with respect to the third panel 506 such that the fifth and sixth side flaps 518, 520 are against the second panel 504 and adhered thereto. The first panel 502 is folded about ninety degrees with respect to the second panel 504 such that the first panel 502 is approximately parallel to the third panel 506. The first and second side flaps 510, 512 are folded about ninety degrees with respect to the first panel 502 such that the first side flap 510 is against the third side flap 514 and adhered thereto and the second side flap 512 is against the fourth side flap 516 and adhered thereto. The fourth panel 508 is folded about 180 degrees with respect to the third panel 506 to face an inner surface of the third panel 506 and thereby form the first stop tab ST1.

Some of the panels of a hinged-lid inner pack blank 600 of an example embodiment can include side flaps, one or more of which can be adhered to other portions of the pack blank 600 to form a hinged-lid inner pack 30. For example, a pack blank 600 can include a first flap 624 connected to one side of the second panel 604 along a first longitudinal fold line L1, a second flap 626 connected to an opposite side of the second panel 604 along a second longitudinal fold line L2, a third flap 628 connected to one side of the fourth panel 608 along a third longitudinal fold line L3, a fourth flap 630 connected to an opposite side of the fourth panel 608 along a fourth longitudinal fold line L4, a fifth flap 632 connected to an end of the third flap 628 along an eleventh transverse fold line T11, and a sixth flap 634 connected to an end of the fourth flap 630 along a twelfth transverse fold line T12. A pack blank 600 of an example embodiment can further include a seventh flap 636 connected to one side of the fifth panel 610 along a fifth longitudinal fold line L5, an eighth flap 638 connected to an opposite side of the fifth panel 610 along a sixth longitudinal fold line L6, a ninth flap 640 connected to one side of the eighth panel 616 along a seventh longitudinal fold line L7, a tenth flap 642 connected to an opposite side of the eighth panel 616 along an eighth longitudinal fold line L8, an eleventh flap 644 connected to one end of the ninth flap 640 along a thirteenth transverse fold line T13, and a twelfth flap 646 connected to one end of the tenth flap 642 along a fourteenth transverse fold line T14. Fifth and sixth flaps 632, 634 can be separated from first and second flaps 624, 626 and third panel 606 by cut lines CL and eleventh and twelfth flaps 644, 646 can be separated from ninth panel 618 by cut lines CL. The cut lines CL between flaps 632, 634 and flaps 624, 626 can be at a slight angle such as at about 95 to about 98 degrees to longitudinal fold lines L1, L2. If desired, the flaps can have other arrangements such as connecting flaps 632, 634 to flaps 624, 626 or panel 606 with suitable fold lines and cut lines.

One or more panels or flaps of a hinged-lid blank 600 can include adhesive thereon for adhering to other panels or flaps and forming a hinged-lid inner pack 30 according to an example embodiment. Alternatively, adhesive can be applied to one or more of the panels and/or flaps during assembly of a blank 600 into a hinged-lid inner pack 30. For example, one or more sides of the sixth panel 612, the seventh panel 614, the third flap 628, the fourth flap 630, the fifth flap 632, the sixth flap 634, the seventh flap 636, the eighth flap 638, the eleventh flap 644 and twelfth flap 646 can include a layer of adhesive and/or adhesive can be applied thereto during assembly. Additional and/or different panels and/or flaps may include adhesive in other example embodiments, and/or adhesive can be applied to additional and/or different panels and/or flaps during assembly.

Figure 13:
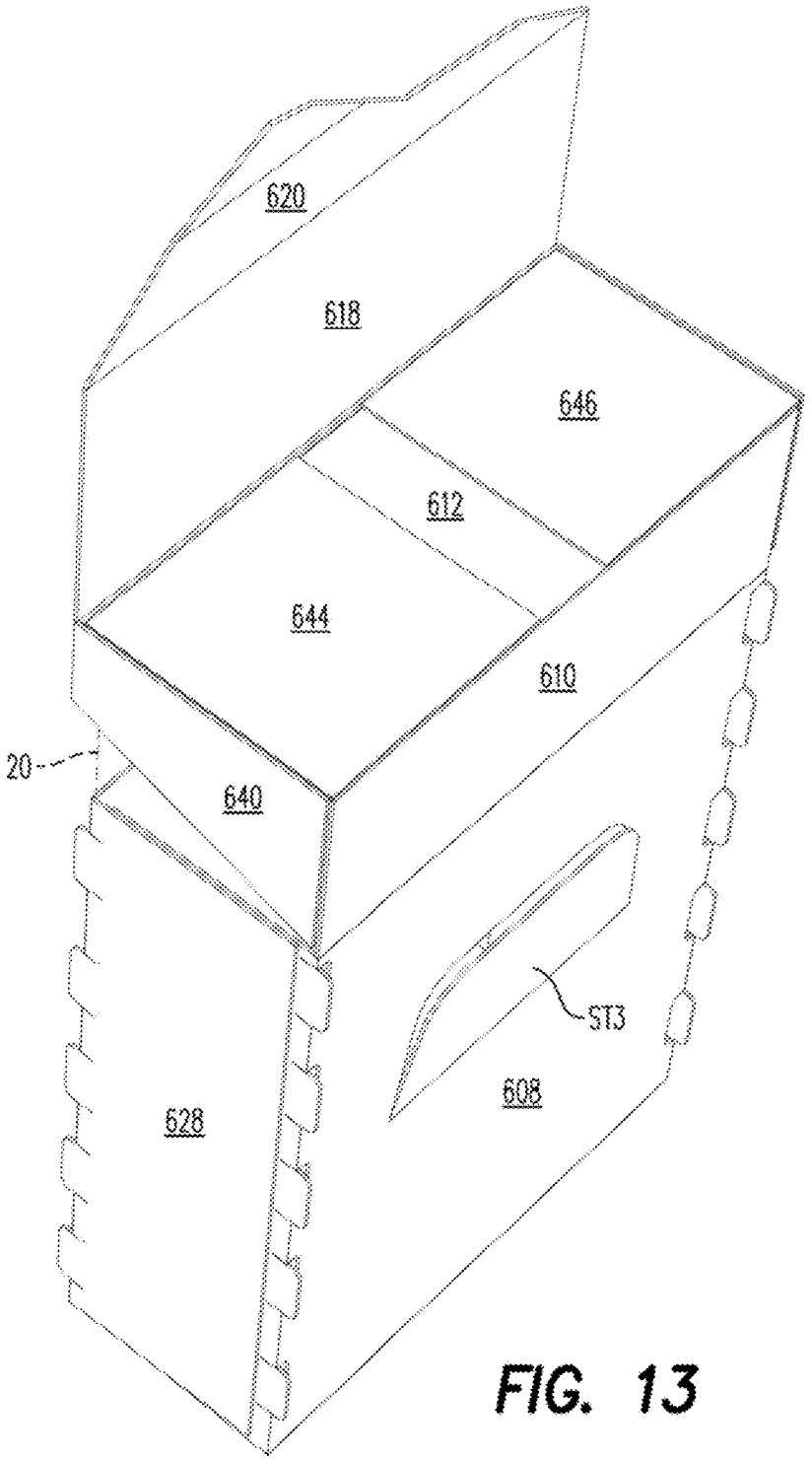

In an example embodiment of assembling a hinged-lid inner pack 30, the fourth panel 608 is folded about 90 degrees with respect to the third panel 606, fifth and sixth flaps 632, 634 are folded about 90 degrees with respect to the third and fourth flaps 628, 630, and the third and fourth flaps 628, 630 are folded about 90 degrees with respect to the fourth panel 608, wherein flaps 632, 634 lie against an interior surface of the third panel 606 and are adhered thereto. The first panel 602 is folded about 180 degrees to lie against the second panel 604, the second panel 604 can be folded about 90 degrees with respect to the third panel 606 and the first and second side flaps 624, 626 can be folded about 90 degrees to lie against the third and fourth side flaps 628, 630 and are adhered thereto. In certain example embodiments, stop tab ST3 is pushed outward, folded about the horizontal line that defines a bottom portion of ST3, so that it sticks out of the fourth panel 608 (see, for example, FIGS. 8, 13, 14). This completes the lower section of a hinged-lid inner pack 30 according to an example embodiment, and a bundle 20 can be placed therein.

Figure 7:
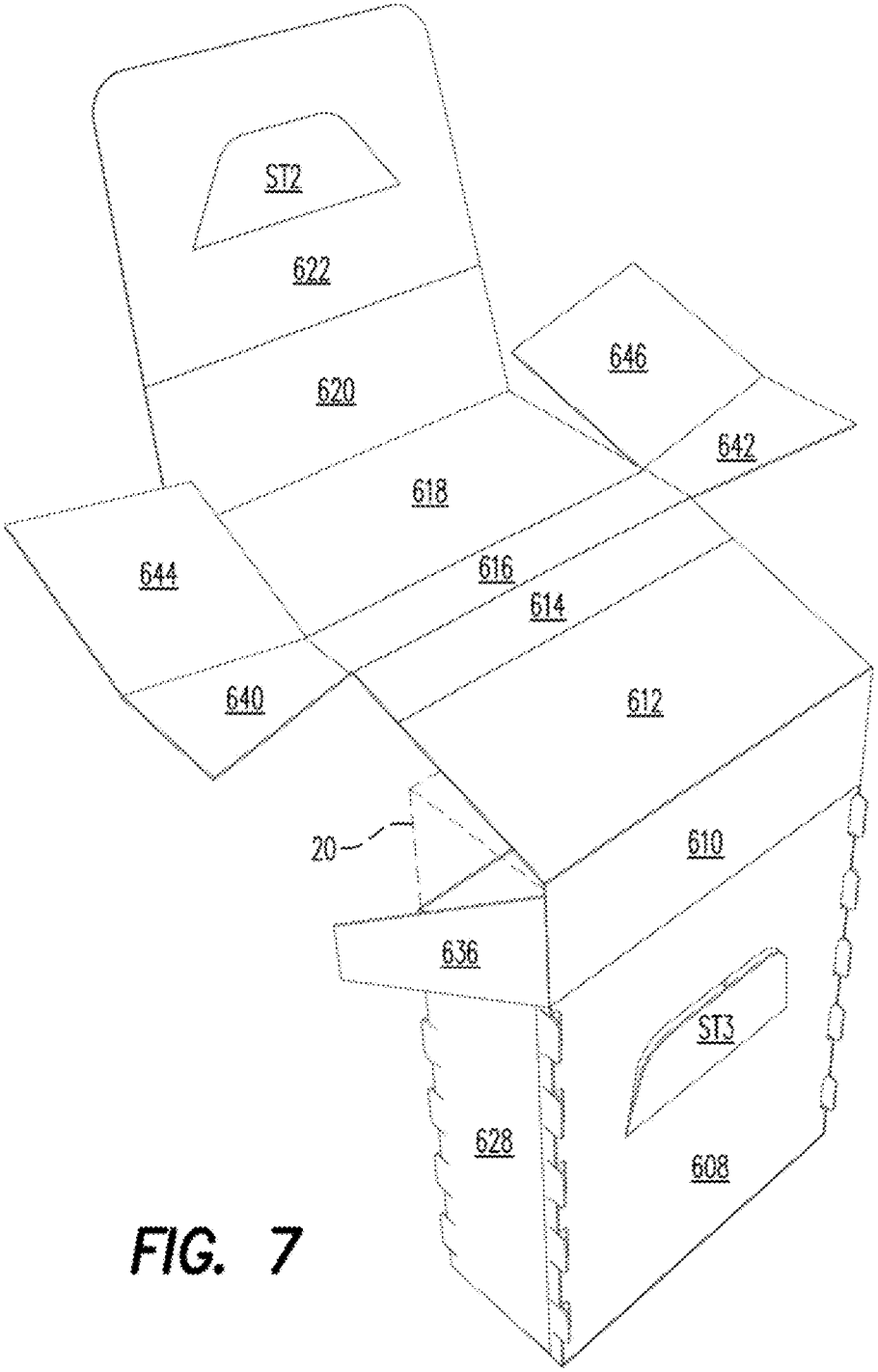
FIGS. 7-14 shows a partially assembled inner pack of a slide-action hinged-lid pack with a foil bundle inside in accordance with example embodiments.
Figure 8:
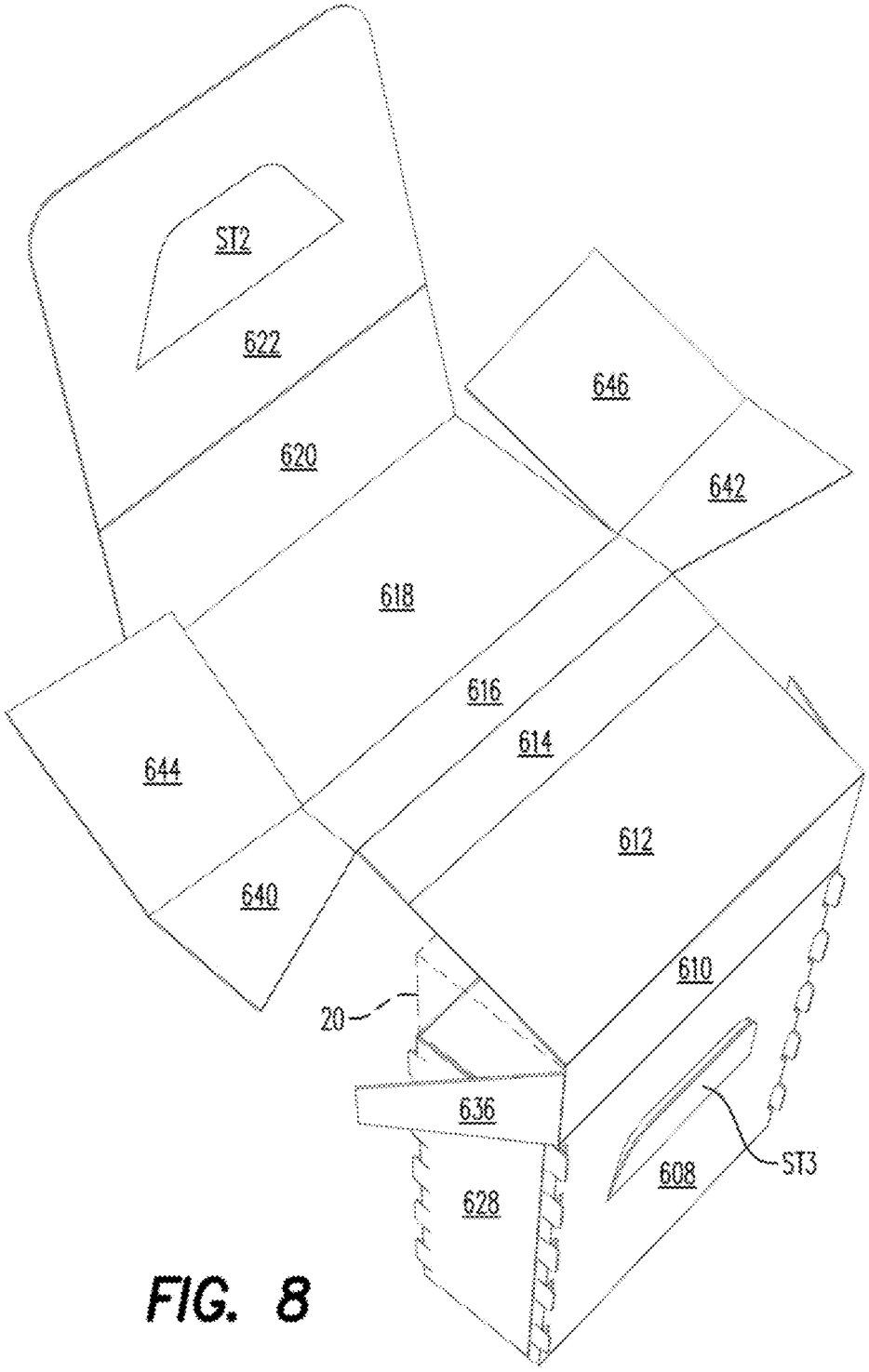
Figure 9:
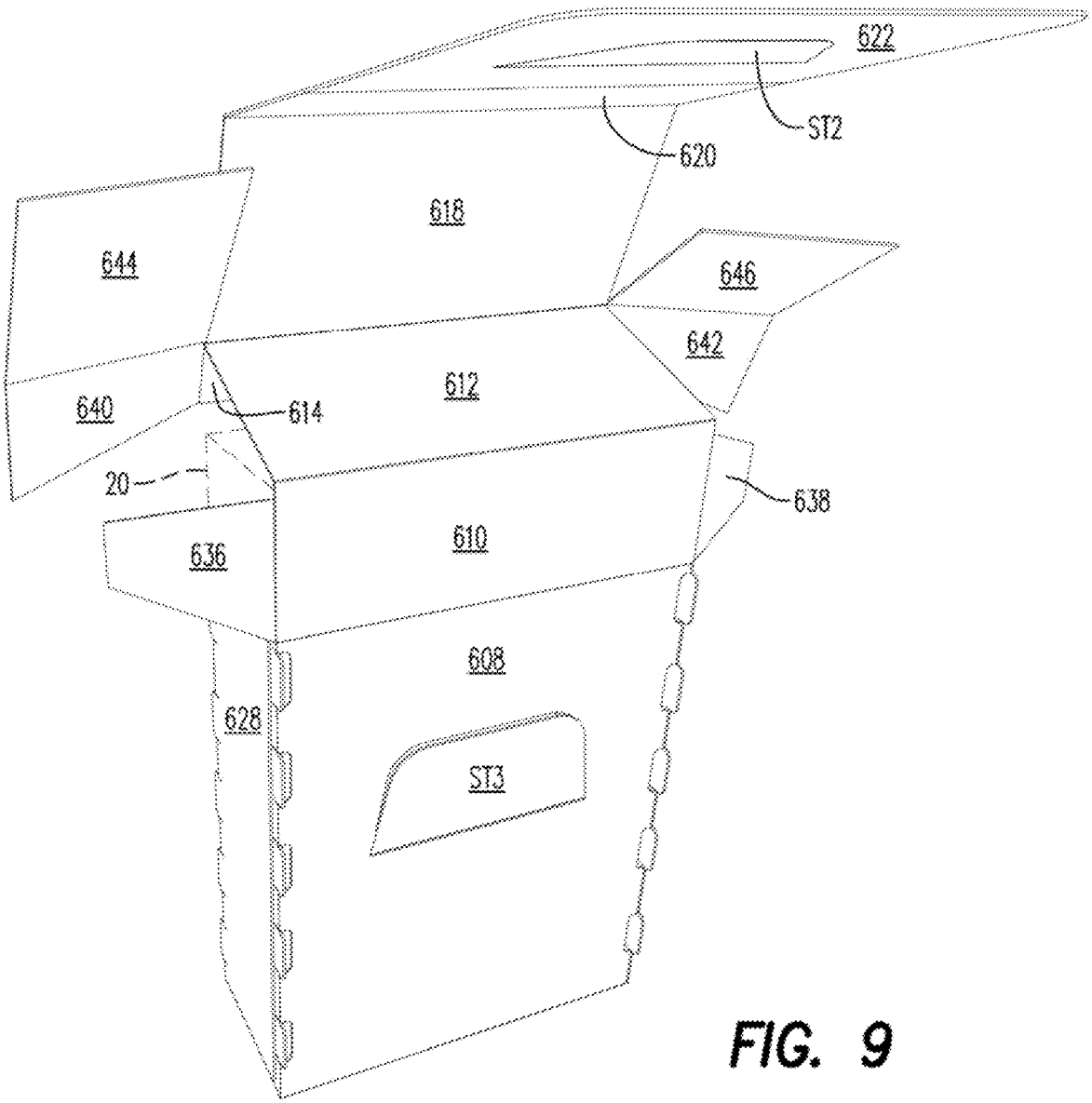

In an example embodiment of forming a hinged-lid L, eight panel 616 is folded about 180 degrees with respect to seventh panel 614 and adhered thereto (or vice-versa seventh panel 614 is folded 180 degrees with respect to the eighth panel 616 and adhered thereto), and the seventh panel 614 is folded about 90 degrees with respect to the sixth panel 612. FIGS. 7-8 show a partially assembled hinged-lid inner pack 30 wherein the hinged-lid L is not yet assembled, and wherein the seventh panel 614 will form an inner layer of a front wall 38*a* of the lid once assembled. FIG. 9 shows the partially assembled hinged-lid inner pack of FIG. 8 wherein the seventh panel 614 and the eighth panel 616 are adhered (the eight panel 616 forms an outer layer of the front wall 38*a* of the lid) and the seventh panel 614 has been folded about 90 degrees with respect to the sixth panel 612. The sixth panel 612 and ninth panel 618 are now adjacent each other and as explained later, the ninth panel 618 will be adhered to the sixth panel 612 (and/or to intervening flaps) to form a double layer top wall 36 of the lid L.

Figure 10:
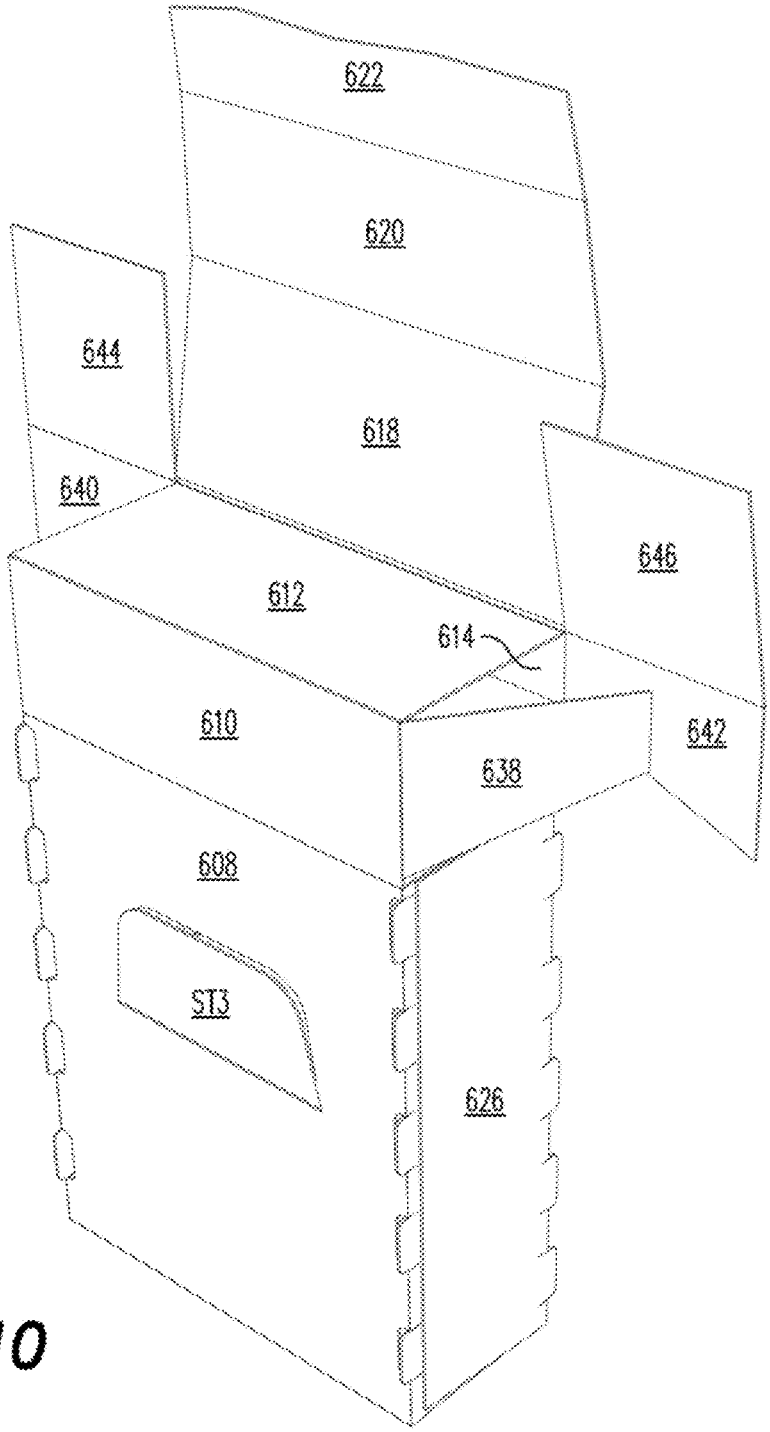
Figure 11:
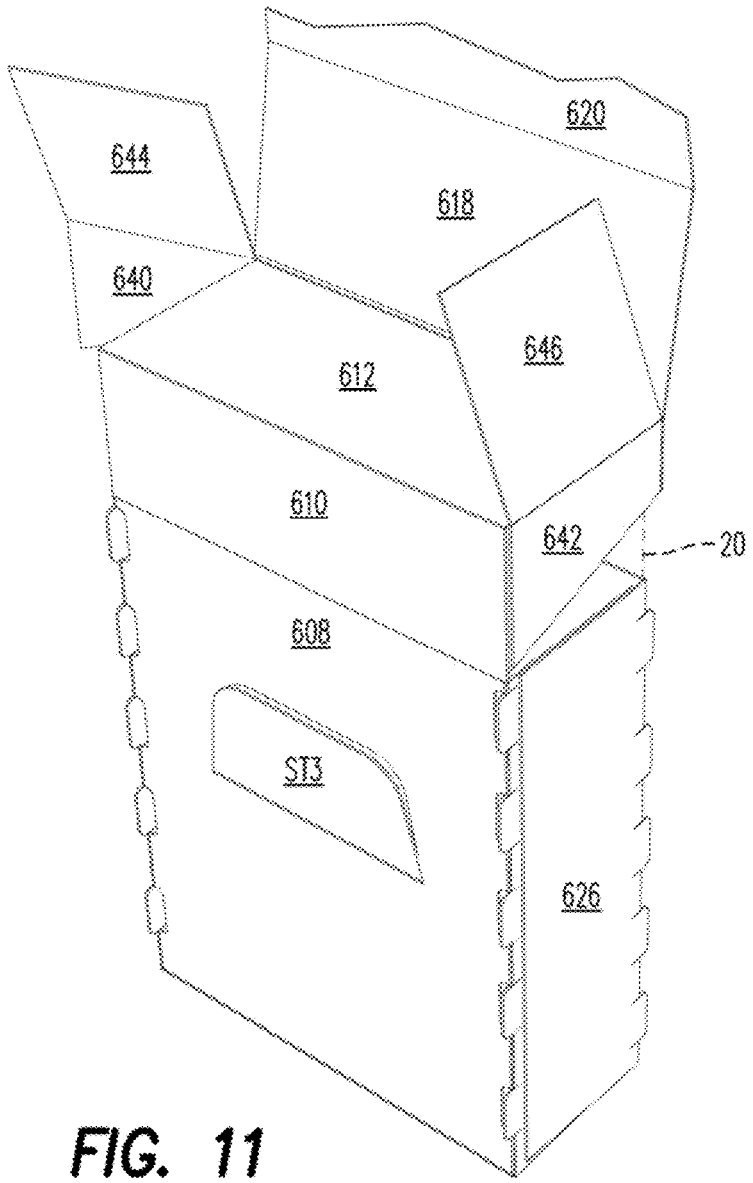

After the front wall 38*a* of the lid L is formed, the sixth panel 612 is folded about 90 degrees with respect to the fifth panel 610 so as to lie against the top of a bundle 20 that was placed in the lower section of the hinged-lid inner pack 30. With the fifth panel 610 against a back of the bundle, the seventh flap 636 and the eighth flap 638 are folded about 90 degrees with respect to the fifth panel 610 so as to lie against sides of the bundle 20 (for example, FIG. 10 shows flap 638 partially folded before it gets to approximately 90 degrees to lie against a side of the bundle). After adhesive is applied to the ninth flap 640 and tenth flap 642 and/or to the seventh and eighth flaps 636, 638, the ninth and tenth flaps 640 and 642 are folded about 90 degrees with respect to eighth panel 616 and adhered to the seventh and eighth flaps 636, 638 to form double layer side walls 38*c*, 38*d* of the lid L (for example, FIG. 11 shows flap 642 folded about 90 degrees with respect to eight panel 616 and adhered to flap 638, while flap 640 is partially folded before it gets to the approximately 90 degrees to lie against and be adhered to flap 636).

Figure 12:
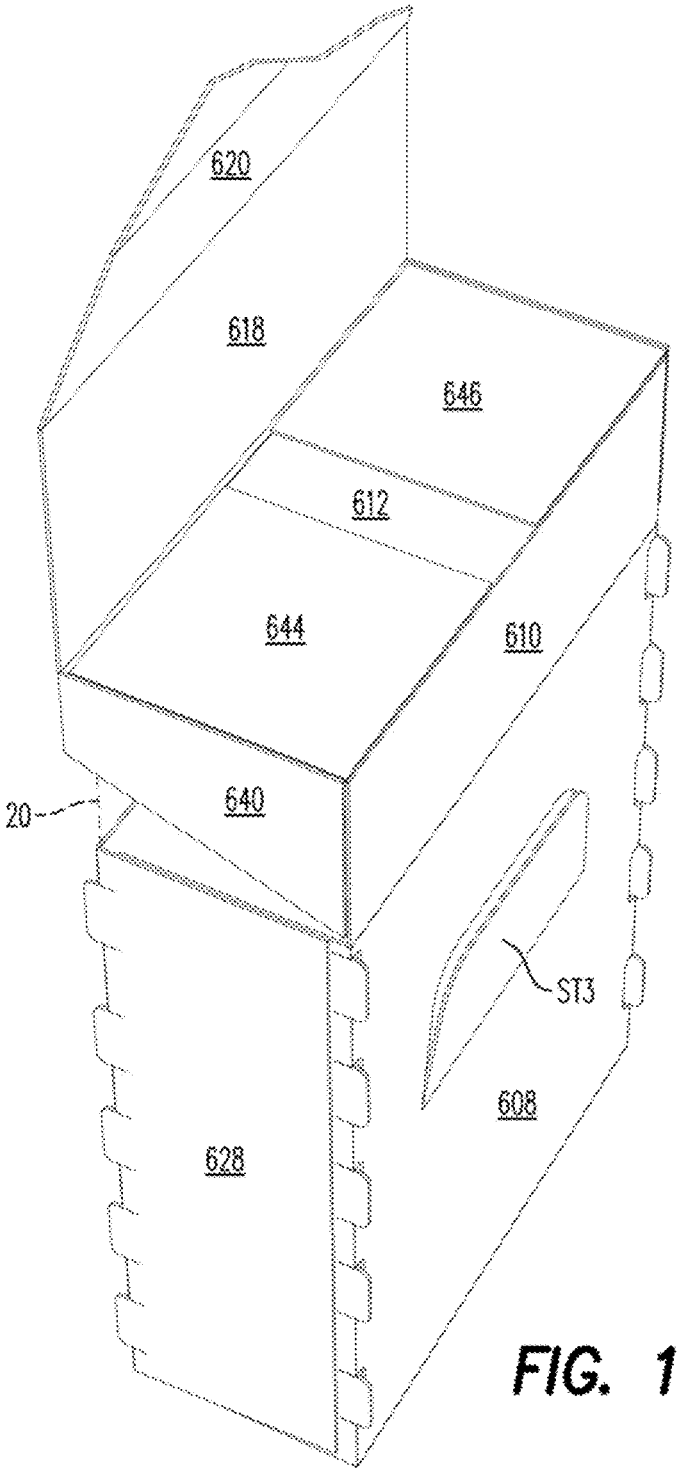
Figure 14:
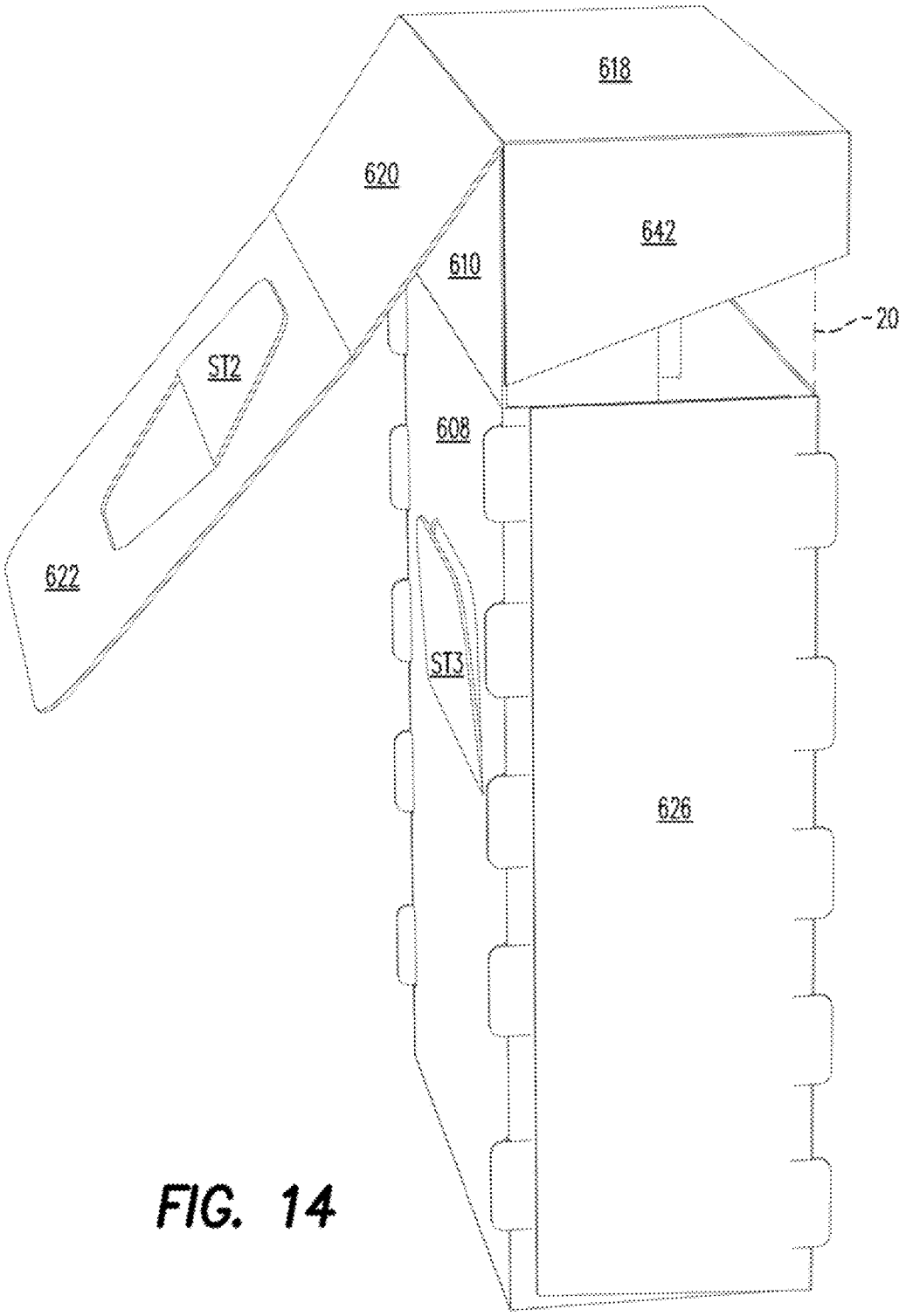

To form the remainder of the lid L according to an example embodiment, adhesive can be applied to the undersides of eleventh and twelfth flaps 644, 646 and/or the top of the sixth panel 612, and the eleventh and twelfth flaps 644, 646 are folded about 90 degrees to lie against and adhere to the sixth panel 612 (see, e.g., FIG. 12). Some example embodiments may not use adhesive in the panels and/or flaps as described herein, or some embodiments may use adhesive in additional panels and/or flaps. For example, some embodiments may not use adhesive between the flaps 644, 646 and the panel 612, and instead flaps 644, 646 may simply just lie against the panel 612 without adhesive. To complete the lid L, adhesive is applied to the tops of the eleventh and twelfth flaps 644, 646, to the underside of the ninth panel 618 and/or to the top the sixth panel 612 (see, e.g., FIG. 13), and the ninth panel 618 is folded about 90 degrees and is adhered to the eleventh and twelfth flaps 644, 646 and/or to the sixth panel 612, as shown in FIG. 14. Thus, the lid L includes inner and outer panels forming the top wall 36, front wall 38*a*, side wall 38*c*, and side wall 38*d*, and a panel 610 forming a back wall 38*b*, of a lid L. In an example embodiment, the tenth and eleventh panels 620, 622 form the tongue 37 which extends from the back edge of the top wall 36 of the lid L. The tongue 37 is folded downwardly with respect to the top wall 36, so that the tongue extends downwardly from the edge of the top wall 36. In an example embodiment, stop tab ST2 is pushed outward of panel 622 and folded about 90 to 180 degrees with respect to panel 622. As mentioned above, in some embodiments, more adhesive or less adhesive can be used in the various panels and/or flaps to construct examples of outer shells 40, inner packs 30 and/or slide-action hinged-lid packs 10.

As mentioned above, the hinged-lid inner pack 30 can include projections P to space the hinged-lid inner pack 30 inward of the front and back walls 41, 42 of the outer shell 40. In an example embodiment, the first longitudinal fold line L1 includes a series of U-shaped cuts UC forming projections P extending outwardly from the front wall 31 of the hinged-lid inner pack 30, the second longitudinal fold line L2 includes a series of U-shaped cuts UC forming projections P extending outwardly from the front wall 31 of the hinged-lid inner pack 30, the third longitudinal fold line L3 includes a series of U-shaped cuts UC forming projections P extending outwardly from the back wall 32 of the hinged-lid inner pack 30, and the fourth longitudinal fold line L4 includes a series of U-shaped cuts UC forming projections P extending outwardly from the back wall 32 of the hinged-lid inner pack 30. In the example shown in FIG. 6, while there are five evenly spaced U-shaped cuts UC along each of the longitudinal fold lines L1, L2, L3, L4, if desired a smaller number of U-shaped cuts or larger number of U-shaped cuts can be provided along the fold lines. Thus, in some example embodiments, when the first, second, third and fourth side flaps 624, 626, 628, 630 are folded and adhered together to form the lower section of the hinged-lid inner pack 30, the projections P extend outward of the front and back walls of the hinged-lid inner pack 30 and provide a first gap between the front wall 41 of the outer shell 40 and the front wall 31 of the hinged-lid inner pack 30 and a second gap between the back wall 42 of the outer shell 40 and the back wall 32 of the hinged-lid inner pack 30.

In an example embodiment, stop tabs ST3 and ST2 can be formed from cuts and fold lines in the panels forming the back wall of the hinged-lid inner pack 30 and the tongue 37. The first stop tab ST1 can comprise a fourth panel 508 of the outer shell blank 500 folded about 180 degrees to form a downwardly extending flap ST1 pivotally connected to an upper end of the back wall 42 of the outer shell 40, the flap ST1 having a free end extending downwardly by a first distance D1 which is less than a second distance D2 between the front wall 41 and back wall 42 of the outer shell 40. The second stop tab ST2 can comprise an upwardly extending flap ST2 connected to the tongue 37 along a transverse fold line PFL2 (in some example embodiments, this fold line is perforated), and the third stop tab ST3 can comprise a second upwardly extending flap ST3 connected to the back wall 32 of the hinged-lid inner pack 30 along a transverse fold line ST3FL.

In an example embodiment, the flap ST2 has a trapezoidal shape formed by a first cutline CL1 in a central portion of the tongue 37. The first cutline CL1 can include first and second angled sections extending from opposite ends of the transverse fold line PFL2 towards the free end of the tongue 37 and a rectilinear section connecting the first and second angled sections (curved corners may connect the angled sections with the rectilinear section), the rectilinear section parallel to and spaced from the transverse fold line PFL2 by a distance D3 which is less that the distance D1 in some example embodiments. The flap ST2 can be folded about 180 degrees or less with respect to the tongue 37 such that a free end of the flap ST2 faces away from the free end of the tongue 37. The flap ST3 can also have a trapezoidal shape formed by a second cutline CL2 in a central portion of the back wall 32 of the hinged-lid inner pack 30. The second cutline CL2 can include first and second angled sections extending from opposite ends of the transverse fold line ST3FL towards the lid L of the hinged-lid inner pack 30 and a rectilinear section connecting the first and second angled sections (curved corners may connect the angled sections with the rectilinear section), the rectilinear section parallel to and spaced from the transverse fold line ST3FL by a fourth distance D4 which is greater than the third distance D3 in some example embodiments.

In operating the pack 10 by sliding the hinged-lid inner pack 30 away from the bottom wall 45 of the outer shell 40, the free end of the upwardly extending flap ST3 abuts a bottom end (e.g., said bottom end can include the transverse fold line PLF2) of the first upwardly extending flap ST2 when the lid L is fully open. Such abutment occurs because a gap between the upwardly extending flap ST2 and a portion of the tongue 37 adjacent the upwardly extending flap ST2 forms a catch which engages the free end of the downwardly extending flap ST1 when the hinged-lid inner pack 30 is moved away from the bottom wall 45 of the outer shell 40 and causes the lid L to rotate from a closed position to an open position (as this happens, ST3 moves toward flap ST2, and at a certain point the free end of ST3 abuts the bottom end of ST2 and stops the movement).

As noted in example embodiments, the hinged-lid inner pack blank 600 can include one or more of the fold lines which include one or more perforations. While this is shown in some figures and/or was mentioned in some example embodiments for some of the fold lines, any one of the fold lines can include one or more perforations, which in some cases may facilitate folding. In other example embodiments, the perforations can be omitted from the fold lines.

In an example embodiment, a slide-action hinged-lid pack 10, comprises an outer shell 40 and a hinged-lid inner pack 30 configured to hold consumer items. The hinged-lid inner pack 30 can comprise a single blank 600 assembled into a front wall 31, a back wall 32, a right side wall 33, a left side wall 34, a bottom wall 35 and a hinged-lid L pivotally connected to an upper end of the back wall 32 for movement between an open position to a closed position, the hinged-lid L comprising a double layer front wall 38*a*, a back wall 38*b*, a double layer right side wall 38*c*, a double layer left side wall 38*d* and a double layer top wall 36. The outer shell 40 can comprise a single blank 500 assembled into a front wall 41, a back wall 42, a left side wall 44, a right side wall 43 and a bottom wall 45. In an example embodiment, the outer shell 40 and the hinged-lid inner pack 30 are arranged such that the hinged-lid inner pack can slide from a first position at which a top panel 36 of the hinged-lid L is in the closed position and fits within a rectangular opening at upper ends of the front, back and side walls 41-44 of the outer shell 40 to a second position at which the hinged-lid L is in the open position. The outer shell can include a first stop tab ST1 on an inner side of the back wall 42, the hinged-lid inner pack 30 can include a second stop tab ST2 on a tongue 37 extending from the hinged-lid L, and the hinged-lid inner pack 30 can include a third stop tab ST3 on extending outward of the back wall 32. The second stop tab ST2 can be operable to engage the first stop tab ST1 during movement of the hinged-lid inner pack 30 from the first position to the second position, and the third stop tab ST3 can be operable to abut the second stop tab ST2 when the hinged-lid L is moved to the open position.

In an example embodiment, the hinged-lid inner pack can include projections P extending outward of the front and back walls 31, 32 of the hinged-lid inner pack 30 such that the front and back walls 31, 32 of the hinged-lid inner pack 30 are spaced inwardly of the front and back walls 41, 42 of the outer shell 40. The projections P can be formed by a series of spaced-apart U-shaped cuts along fold lines between the front wall 31 and side walls 33, 34 of the hinged-lid inner pack 30 and a series of spaced-apart U-shaped cuts along fold lines between the back wall 32 and the side walls 33, 34 of the hinged-lid inner pack 30.

In an example embodiment, the consumer items can comprise a bundle 20 of smoking articles, the bundle 20 located in the hinged-lid inner pack 30 such that a free end of the bundle 20 is exposed when the lid L is in an open position, a free end of the bundle 20 is covered by the lid L when the lid L is in a closed position, and the free end of the bundle 20 extends outward from an opening at upper ends of the front, back and side walls 41-44 of the outer shell 40 when the hinged-lid inner pack 30 is in an open position.

In an example embodiment, the first stop tab ST1 comprises a downwardly extending flap connected to the back wall 42 of the outer shell 40, the second stop tab ST2 comprises an upwardly extending flap connected to the tongue 37, and the third stop tab ST3 comprises an upwardly extending flap connected to the back wall 32 of the hinged-lid inner pack 30.

Thus, it will be appreciated by those skilled in the art that the present disclosure can be embodied in other specific forms without departing from the spirit thereof. The presently disclosed embodiments are therefore considered in all respects to be illustrative and not restricted. The scope of the inventions herein are indicated by the appended claims rather than the foregoing description and all changes that come within the meaning and range and equivalence thereof are intended to be embraced therein.

What is claimed is:

1. A blank for forming a hinged-lid inner pack, the blank comprising:

a first panel;

a second panel coupled to the first panel along a first transverse fold line;

a third panel coupled to the second panel along a second transverse fold line;

a fourth panel coupled to the third panel along a third transverse fold line;

a fifth panel coupled to the fourth panel along a fourth transverse fold line;

a sixth panel coupled to the fifth panel along a fifth transverse fold line;

a seventh panel coupled to the sixth panel along a sixth transverse fold line;

an eighth panel coupled to the seventh panel along a seventh transverse fold line; a ninth panel coupled to the eighth panel along an eighth transverse fold line;

a first flap coupled to a first side of the second panel along a first longitudinal fold line, the first longitudinal fold line including a first series of U-shaped cuts that form a first plurality of projections that extend outwardly from the second panel in a first direction when folded along the first longitudinal fold line; and a second flap coupled to a second side of the second panel along a second longitudinal fold line, the second longitudinal fold line including a second series of U-shaped cuts that form a second plurality of projections that extend outwardly from the second panel in the first direction when folded along the second longitudinal fold line, the second side of the second panel being opposite to the first side of the second panel.

2. The blank of claim 1, further comprising:

a third flap coupled to a first side of the fourth panel along a third longitudinal fold line; and a fourth flap coupled to second side of the fourth panel along a fourth longitudinal fold line, the second side of the fourth panel being opposite to the first side of the fourth panel.

3. The blank of claim 2, wherein the third longitudinal fold line includes a third series of U-shaped cuts that form a third plurality of projections that extend outwardly from the fourth panel in a second direction when folded, and the fourth longitudinal fold line includes a fourth series of U-shaped cuts that form a fourth plurality of projections that extend outwardly from the fourth panel in the second direction when folded.

4. The blank of claim 3, further comprising:

a fifth flap coupled to an end of the third flap along an eleventh transverse fold line; and a sixth flap coupled to an end of the fourth flap along a twelfth transverse fold line.

5. The blank of claim 4, wherein the fifth flap and the sixth flap are separated from the first flap, the second flap, and the third panel by cut lines.

6. The blank of claim 5, wherein the cut lines have an angle of 95 degrees to 98 degrees.

7. The blank of claim 4, further comprising:

a seventh flap coupled to a first side of the fifth panel along a fifth longitudinal fold line; and an eighth flap coupled to a second side of the fifth panel along a sixth longitudinal fold line, the second side of the fifth panel being opposite to the first side of the fifth panel.

8. The blank of claim 7, wherein the seventh flap and the eighth flap each have a trapezoidal shape.

9. The blank of claim 7, further comprising:

a ninth flap coupled to a first side of the eighth panel along a seventh longitudinal fold line; and a tenth flap coupled to a second side of the eighth panel along an eighth longitudinal fold line.

10. The blank of claim 9, wherein the ninth flap and the tenth flap each have a trapezoidal shape.

11. The blank of claim 9, wherein the ninth panel is coupled to a tenth panel along a ninth transverse fold line.

12. The blank of claim 11, further comprising:

an eleventh flap coupled to an end of the ninth flap along a thirteenth transverse fold line; and a twelfth flap coupled to an end of the tenth flap along a fourteenth transverse fold line.

13. The blank of claim 12, wherein the eleventh flap and the twelfth flap are separated from the ninth panel by cut lines.

14. The blank of claim 13, wherein the cut lines have an angle of 95 degrees to 98 degrees.

15. The blank of claim 12, wherein one or more sides of the sixth panel, the seventh panel, the third flap, the fourth flap, the fifth flap, the sixth flap, the seventh flap, the eighth flap, the eleventh flap, and the twelfth flap includes an adhesive layer.

16. The blank of claim 11, wherein the tenth panel is coupled to an eleventh panel along a tenth transverse fold line.

17. The blank of claim 16, wherein the eleventh panel defines a tongue.

18. The blank of claim 16, wherein the eleventh panel includes a first stop tab.

19. The blank of claim 17, wherein the fourth panel includes a second stop tab.

20. The blank of claim 18, wherein the blank includes a paperboard material.

* * * * *